US009127665B2

(12) United States Patent
Locke et al.

(10) Patent No.: US 9,127,665 B2
(45) Date of Patent: Sep. 8, 2015

(54) DISC PUMP WITH ADVANCED ACTUATOR

(71) Applicant: KCI Licensing, Inc., San Antonio, TX (US)

(72) Inventors: Christopher Brian Locke, Bournemouth (GB); Aidan Marcus Tout, Alderbury (GB)

(73) Assignee: KCI Licensing, Inc., San Antonio, TX (US)

( * ) Notice: Subject to any disclaimer, the term of this patent is extended or adjusted under 35 U.S.C. 154(b) by 302 days.

(21) Appl. No.: 13/782,665

(22) Filed: Mar. 1, 2013

(65) Prior Publication Data

US 2013/0236338 A1 Sep. 12, 2013

Related U.S. Application Data

(60) Provisional application No. 61/607,904, filed on Mar. 7, 2012.

(51) Int. Cl.

| | |
|---|---|
| ***F04B 45/047*** | (2006.01) |
| ***F04B 45/04*** | (2006.01) |
| ***F04B 43/02*** | (2006.01) |
| ***F04B 43/04*** | (2006.01) |
| ***F04B 53/10*** | (2006.01) |

(52) U.S. Cl.

CPC ..... *F04B 45/04* (2013.01); *F04B 43/023* (2013.01); *F04B 43/043* (2013.01); *F04B 53/10* (2013.01)

(58) Field of Classification Search

CPC .... F04B 43/023; F04B 43/043; F04B 43/046; F04B 45/04; F04B 45/041

USPC ..... 417/413.2; 92/102, 103

See application file for complete search history.

(56) References Cited

U.S. PATENT DOCUMENTS

| | | | |
|---|---|---|---|
| 1,355,846 | A | 10/1920 | Rannells |
| 2,547,758 | A | 4/1951 | Keeling |
| 2,632,443 | A | 3/1953 | Lesher |
| 2,682,873 | A | 7/1954 | Evans et al. |

(Continued)

FOREIGN PATENT DOCUMENTS

| | | | |
|---|---|---|---|
| AU | 550575 | A1 | 3/1986 |
| AU | 745271 | | 4/1999 |

(Continued)

OTHER PUBLICATIONS

International Search Report and Written Opinion for corresponding PCT/US2013/028534, mailed May 23, 2013.

(Continued)

*Primary Examiner* — Charles Freay

(57) ABSTRACT

A two-cavity pump having a single valve in one cavity and a bidirectional valve in another cavity is disclosed. The pump has a side wall closed by two end walls for containing a fluid. An actuator is disposed between the two end walls and functions as a portion of a common end wall of the two cavities. The actuator causes an oscillatory motion of the common end walls to generate radial pressure oscillations of the fluid within both cavities. An isolator flexibly supports the actuator. The first cavity includes the single valve disposed in one of a first and second aperture in the end wall to enable fluid flow in one direction. The second cavity includes the bidirectional valve disposed in one of a third and fourth aperture in the end wall to enable fluid flow in both directions.

23 Claims, 10 Drawing Sheets

(56) References Cited

U.S. PATENT DOCUMENTS

| | | | | |
|---|---|---|---|---|
| 2,910,763 | A | 11/1959 | Lauterbach | |
| 2,969,057 | A | 1/1961 | Simmons | |
| 3,029,743 | A * | 4/1962 | Johns | 417/322 |
| 3,066,672 | A | 12/1962 | Crosby, Jr. et al. | |
| 3,367,332 | A | 2/1968 | Groves | |
| 3,520,300 | A | 7/1970 | Flower, Jr. | |
| 3,568,675 | A | 3/1971 | Harvey | |
| 3,606,592 | A * | 9/1971 | Madurski et al. | 417/413.1 |
| 3,648,692 | A | 3/1972 | Wheeler | |
| 3,682,180 | A | 8/1972 | McFarlane | |
| 3,826,254 | A | 7/1974 | Mellor | |
| 4,080,970 | A | 3/1978 | Miller | |
| 4,096,853 | A | 6/1978 | Weigand | |
| 4,139,004 | A | 2/1979 | Gonzalez, Jr. | |
| 4,165,748 | A | 8/1979 | Johnson | |
| 4,184,510 | A | 1/1980 | Murry et al. | |
| 4,233,969 | A | 11/1980 | Lock et al. | |
| 4,245,630 | A | 1/1981 | Lloyd et al. | |
| 4,256,109 | A | 3/1981 | Nichols | |
| 4,261,363 | A | 4/1981 | Russo | |
| 4,275,721 | A | 6/1981 | Olson | |
| 4,284,079 | A | 8/1981 | Adair | |
| 4,297,995 | A | 11/1981 | Golub | |
| 4,333,468 | A | 6/1982 | Geist | |
| 4,373,519 | A | 2/1983 | Errede et al. | |
| 4,382,441 | A | 5/1983 | Svedman | |
| 4,392,853 | A | 7/1983 | Muto | |
| 4,392,858 | A | 7/1983 | George et al. | |
| 4,419,097 | A | 12/1983 | Rowland | |
| 4,465,485 | A | 8/1984 | Kashmer et al. | |
| 4,475,909 | A | 10/1984 | Eisenberg | |
| 4,480,638 | A | 11/1984 | Schmid | |
| 4,525,166 | A | 6/1985 | Leclerc | |
| 4,525,374 | A | 6/1985 | Vaillancourt | |
| 4,540,412 | A | 9/1985 | Van Overloop | |
| 4,543,100 | A | 9/1985 | Brodsky | |
| 4,548,202 | A | 10/1985 | Duncan | |
| 4,551,139 | A | 11/1985 | Plaas et al. | |
| 4,569,348 | A | 2/1986 | Hasslinger | |
| 4,605,399 | A | 8/1986 | Weston et al. | |
| 4,608,041 | A | 8/1986 | Nielsen | |
| 4,640,688 | A | 2/1987 | Hauser | |
| 4,648,807 | A * | 3/1987 | Tippetts et al. | 417/413.2 |
| 4,655,754 | A | 4/1987 | Richmond et al. | |
| 4,664,662 | A | 5/1987 | Webster | |
| 4,710,165 | A | 12/1987 | McNeil et al. | |
| 4,733,659 | A | 3/1988 | Edenbaum et al. | |
| 4,743,232 | A | 5/1988 | Kruger | |
| 4,758,220 | A | 7/1988 | Sundblom et al. | |
| 4,787,888 | A | 11/1988 | Fox | |
| 4,826,494 | A | 5/1989 | Richmond et al. | |
| 4,838,883 | A | 6/1989 | Matsuura | |
| 4,840,187 | A | 6/1989 | Brazier | |
| 4,863,449 | A | 9/1989 | Therriault et al. | |
| 4,872,450 | A | 10/1989 | Austad | |
| 4,878,901 | A | 11/1989 | Sachse | |
| 4,897,081 | A | 1/1990 | Poirier et al. | |
| 4,906,233 | A | 3/1990 | Moriuchi et al. | |
| 4,906,240 | A | 3/1990 | Reed et al. | |
| 4,919,654 | A | 4/1990 | Kalt et al. | |
| 4,941,882 | A | 7/1990 | Ward et al. | |
| 4,953,565 | A | 9/1990 | Tachibana et al. | |
| 4,969,880 | A | 11/1990 | Zamierowski | |
| 4,985,019 | A | 1/1991 | Michelson | |
| 5,037,397 | A | 8/1991 | Kalt et al. | |
| 5,086,170 | A | 2/1992 | Luheshi et al. | |
| 5,092,858 | A | 3/1992 | Benson et al. | |
| 5,100,396 | A | 3/1992 | Zamierowski | |
| 5,134,994 | A | 8/1992 | Say | |
| 5,149,331 | A | 9/1992 | Ferdman et al. | |
| 5,167,613 | A | 12/1992 | Karami et al. | |
| 5,176,663 | A | 1/1993 | Svedman et al. | |
| 5,215,522 | A | 6/1993 | Page et al. | |
| 5,232,453 | A | 8/1993 | Plass et al. | |
| 5,261,893 | A | 11/1993 | Zamierowski | |
| 5,278,100 | A | 1/1994 | Doan et al. | |
| 5,279,550 | A | 1/1994 | Habib et al. | |
| 5,298,015 | A | 3/1994 | Komatsuzaki et al. | |
| 5,342,376 | A | 8/1994 | Ruff | |
| 5,344,415 | A | 9/1994 | DeBusk et al. | |
| 5,358,494 | A | 10/1994 | Svedman | |
| 5,437,622 | A | 8/1995 | Carion | |
| 5,437,651 | A | 8/1995 | Todd et al. | |
| 5,527,293 | A | 6/1996 | Zamierowski | |
| 5,549,584 | A | 8/1996 | Gross | |
| 5,556,375 | A | 9/1996 | Ewall | |
| 5,607,388 | A | 3/1997 | Ewall | |
| 5,636,643 | A | 6/1997 | Argenta et al. | |
| 5,645,081 | A | 7/1997 | Argenta et al. | |
| 6,071,267 | A | 6/2000 | Zamierowski | |
| 6,074,178 | A * | 6/2000 | Bishop et al. | 417/322 |
| 6,079,214 | A * | 6/2000 | Bishop | 62/6 |
| 6,135,116 | A | 10/2000 | Vogel et al. | |
| 6,241,747 | B1 | 6/2001 | Ruff | |
| 6,287,316 | B1 | 9/2001 | Agarwal et al. | |
| 6,345,623 | B1 | 2/2002 | Heaton et al. | |
| 6,488,643 | B1 | 12/2002 | Tumey et al. | |
| 6,493,568 | B1 | 12/2002 | Bell et al. | |
| 6,553,998 | B2 | 4/2003 | Heaton et al. | |
| 6,814,079 | B2 | 11/2004 | Heaton et al. | |
| 8,841,820 | B2 * | 9/2014 | Bennett et al. | 310/328 |
| 2002/0077661 | A1 | 6/2002 | Saadat | |
| 2002/0094285 | A1 | 7/2002 | Paolini et al. | |
| 2002/0115951 | A1 | 8/2002 | Norstrem et al. | |
| 2002/0120185 | A1 | 8/2002 | Johnson | |
| 2002/0143286 | A1 | 10/2002 | Tumey | |
| 2005/0089415 | A1 * | 4/2005 | Cho et al. | 417/413.2 |
| 2007/0065309 | A1 | 3/2007 | Nakajima et al. | |
| 2008/0038125 | A1 * | 2/2008 | Onishi et al. | 417/413.2 |
| 2010/0310398 | A1 * | 12/2010 | Janse Van Rensburg et al. | 417/488 |

FOREIGN PATENT DOCUMENTS

| | | | |
|---|---|---|---|
| AU | 755496 | | 2/2002 |
| CA | 2005436 | | 6/1990 |
| DE | 26 40 413 | A1 | 3/1978 |
| DE | 43 06 478 | A1 | 9/1994 |
| DE | 295 04 378 | U1 | 10/1995 |
| EP | 0100148 | A1 | 2/1984 |
| EP | 0117632 | A2 | 9/1984 |
| EP | 0161865 | A2 | 11/1985 |
| EP | 0358302 | A2 | 3/1990 |
| EP | 1018967 | B1 | 8/2004 |
| GB | 692578 | | 6/1953 |
| GB | 2 195 255 | A | 4/1988 |
| GB | 2 197 789 | A | 6/1988 |
| GB | 2 220 357 | A | 1/1990 |
| GB | 2 235 877 | A | 3/1991 |
| GB | 2 329 127 | B | 3/1999 |
| GB | 2 333 965 | A | 8/1999 |
| JP | 4129536 | | 4/1992 |
| SG | 71559 | | 4/2002 |
| WO | 80/02182 | | 10/1980 |
| WO | 87/04626 | | 8/1987 |
| WO | 90/10424 | | 9/1990 |
| WO | 93/09727 | | 5/1993 |
| WO | 94/20041 | | 9/1994 |
| WO | 96/05873 | | 2/1996 |
| WO | 97/18007 | | 5/1997 |
| WO | 99/13793 | | 3/1999 |
| WO | WO 2006/111775 | A1 | 10/2006 |
| WO | WO 2010/139917 | A1 | 12/2010 |

OTHER PUBLICATIONS

N.A. Bagautdinov, "Variant of External Vacuum Aspiration in the Treatment of Purulent Diseases of the Soft Tissues," Current Problems in Modern Clinical Surgery: Interdepartmental Collection, edited by V. Ye Volkov et al. (Chuvashia State University, Cheboksary, U.S.S.R. 1986);pp. 94-96.

Louis C. Argenta, MD and Michael J. Morykwas, PhD; "Vacuum-Assisted Closure: A New Method for Wound Control and Treatment:

(56) References Cited

OTHER PUBLICATIONS

Animal Studies & Basic Foundation"; Annals of Plastic Surgery, vol. 38, No. 6, Jun. 1997; pp. 553-562.
Susan Mendez-Eastmen, RN; "When Wounds Won't Heal" RN Jan. 1998, vol. 61 (1); Medical Economics Company, Inc., Montvale, NJ, USA; pp. 20-24.
James H. Blackburn, II, MD, et al; "Negative-Pressure Dressings as a Bolster for Skin Grafts"; Annals of Plastic Surgery, vol. 40, No. 5, May 1998, pp. 453-457.
John Masters; "Reliable, Inexpensive and Simple Suction Dressings"; Letters to the Editor, British Journal of Plastic Surgery, 1998, vol. 51 (3), p. 267; Elsevier Science/The British Association of Plastic Surgeons, UK.
S.E. Greer, et al "The Use of Subatmospheric Pressure Dressing Therapy to Close Lymphocutaneous Fistulas of the Groin" British Journal of Plastic Surgery (2000), vol. 53, pp. 484-487.
George V. Letsou, MD., et al; "Stimulation of Adenylate Cyclase Activity in Cultured Endothelial Cells Subjected to Cyclic Stretch"; Journal of Cardiovascular Surgery, vol. 31, 1990, pp. 634-639.
Orringer, Jay, et al; "Management of Wounds in Patients with Complex Enterocutaneous Fistulas"; Surgery, Gynecology & Obstetrics, Jul. 1987, vol. 165, pp. 79-80.
International Search Report for PCT International Application PCT/GB95/01983; Nov. 23, 1995.
PCT International Search Report for PCT International Application PCT/GB98/02713; Jan. 8, 1999.
PCT Written Opinion; PCT International Application PCT/GB98/02713; Jun. 8, 1999.
PCT International Examination and Search Report, PCT International Application PCT/GB96/02802; Jan. 15, 1998 & Apr. 29, 1997.
PCT Written Opinion, PCT International Application PCT/GB96/02802; Sep. 3, 1997.
Dattilo, Philip P., Jr., et al; "Medical Textiles: Application of an Absorbable Barbed Bi-directional Surgical Suture"; Journal of Textile and Apparel, Technology and Management, vol. 2, Issue 2, Spring 2002, pp. 1-5.
Kostyuchenok, B.M., et al; "Vacuum Treatment in the Surgical Management of Purulent Wounds"; Vestnik Khirurgi, Sep. 1986, pp. 18-21 and 6 page English translation thereof.
Davydov, Yu. A., et al; "Vacuum Therapy in the Treatment of Purulent Lactation Mastitis"; Vestnik Khirurgi, May 14, 1986, pp. 66-70, and 9 page English translation thereof.
Yusupov. Yu. N., et al; "Active Wound Drainage", Vestnik Khirurgi, vol. 138, Issue 4, 1987, and 7 page English translation thereof.
Davydov, Yu. A., et al; "Bacteriological and Cytological Assessment of Vacuum Therapy for Purulent Wounds"; Vestnik Khirurgi, Oct. 1988, pp. 48-52, and 8 page English translation thereof.
Davydov, Yu. A., et al; "Concepts for the Clinical-Biological Management of the Wound Process in the Treatment of Purulent Wounds by Means of Vacuum Therapy"; Vestnik Khirurgi, Jul. 7, 1980, pp. 132-136, and 8 page English translation thereof.
Chariker, Mark E., M.D., et al; "Effective Management of incisional and cutaneous fistulae with closed suction wound drainage"; Contemporary Surgery, vol. 34, Jun. 1989, pp. 59-63.
Egnell Minor, Instruction Book, First Edition, 300 7502, Feb. 1975, pp. 24.
Egnell Minor: Addition to the Users Manual Concerning Overflow Protection—Concerns all Egnell Pumps, Feb. 3, 1983, p. 1.
Svedman, P.: "Irrigation Treatment of Leg Ulcers", The Lancet, Sep. 3, 1983, pp. 532-534.
Chinn, Steven D. et al.: "Closed Wound Suction Drainage", The Journal of Foot Surgery, vol. 24, No. 1, 1985, pp. 76-81.
Arnljots, Björn et al.: "Irrigation Treatment in Split-Thickness Skin Grafting of Intractable Leg Ulcers", Scand J. Plast Reconstr. Surg., vol. 19, 1985, pp. 211-213.
Svedman, P.: "A Dressing Allowing Continuous Treatment of a Biosurface", IRCS Medical Science: Biomedical Technology, Clinical Medicine, Surgery and Transplantation, vol. 7, 1979, p. 221.
Svedman, P. et al.: "A Dressing System Providing Fluid Supply and Suction Drainage Used for Continuous or Intermittent Irrigation", Annals of Plastic Surgery, vol. 17, No. 2, Aug. 1986, pp. 125-133.
K.F. Jeter, T.E. Tintle, and M. Chariker, "Managing Draining Wounds and Fistulae: New and Established Methods," Chronic Wound Care, edited by D. Krasner (Health Management Publications, Inc., King of Prussia, PA 1990), pp. 240-246.
G. Živadinovic, V. Đ ukić, Ž. Maksimović, Đ. . Radak, and P. Peška, "Vacuum Therapy in the Treatment of Peripheral Blood Vessels," Timok Medical Journal 11 (1986), pp. 161-164.
F.E. Johnson, "An Improved Technique for Skin Graft Placement Using a Suction Drain," Surgery, Gynecology, and Obstetrics 159 (1984), pp. 584-585.
A.A. Safronov, Dissertation Abstract, Vacuum Therapy of Trophic Ulcers of the Lower Leg with Simultaneous Autoplasty of the Skin (Central Scientific Research Institute of Traumatology and Orthopedics, Moscow, U.S.S.R. 1967).
M. Schein, R. Saadia, J.R. Jamieson, and G.A.G. Decker, "The 'Sandwich Technique' in the Management of the Open Abdomen," British Journal of Surgery 73 (1986), pp. 369-370.
D.E. Tribble, "An Improved Sump Drain-Irrigation Device of Simple Construction," Archives of Surgery 105 (1972) pp. 511-513.
C.E. Tennant, "The Use of Hypermia in the Postoperative Treatment of Lesions of the Extremities and Thorax," Journal of the American Medical Association 64 (1915), pp. 1548-1549.
Selections from W. Meyer and V. Schmieden, Bier's Hyperemic Treatment in Surgery, Medicine, and the Specialties: A Manual of Its Practical Application, (W.B. Saunders Co., Philadelphia, PA 1909), pp. 17-25, 44-64, 90-96, 167-170, and 210-211.
V.A. Solovev et al., Guidelines, The Method of Treatment of Immature External Fistulas in the Upper Gastrointestinal Tract, editor-in-chief Prov. V.I. Parahonyak (S.M. Kirov Gorky State Medical Institute, Gorky, U.S.S.R. 1987) ("Solovev Guidelines").
V.A. Kuznetsov & N.A. Bagautdinov, "Vacuum and Vacuum-Sorption Treatment of Open Septic Wounds," in II All-Union Conference on Wounds and Wound Infections: Presentation Abstracts, edited by B.M. Kostyuchenok et al. (Moscow, U.S.S.R. Oct. 28-29, 1986) pp. 91-92 ("Bagautdinov II").
V.A. Solovev, Dissertation Abstract, Treatment and Prevention of Suture Failures after Gastric Resection (S.M. Kirov Gorky State Medical Institute, Gorky, U.S.S.R. 1988) ("Solovev Abstract").
V.A.C.® Therapy Clinical Guidelines: A Reference Source for Clinicians (Jul. 2007).

* cited by examiner

DISC PUMP WITH ADVANCED ACTUATOR

The present invention claims the benefit, under 35 USC §119(e), of the filing of U.S. Provisional Patent Application Ser. No. 61/607,904, entitled "Disc Pump with Advanced Actuator," filed Mar. 7, 2012, by Locke et al., which is incorporated herein by reference for all purposes.

BACKGROUND OF THE INVENTION

1. Field of the Invention

The illustrative embodiments of the invention relate generally to a pump for fluid and, more specifically, to a pump having two cavities in which each pumping cavity is a substantially disc-shaped, cylindrical cavity having substantially circular end walls and a side wall and which operates via acoustic resonance of fluid within the cavity. More specifically, the illustrative embodiments of the invention relate to a pump in which the two pump cavities each have a different valve structure to provide different fluid dynamic capabilities.

2. Description of Related Art

It is known to use acoustic resonance to achieve fluid pumping from defined inlets and outlets. This can be achieved using a long cylindrical cavity with an acoustic driver at one end, which drives a longitudinal acoustic standing wave. In such a cylindrical cavity, the acoustic pressure wave has limited amplitude. Varying cross-section cavities, such as cone, horn-cone, and bulb shaped cavities have been used to achieve higher amplitude pressure oscillations, thereby significantly increasing the pumping effect. In such higher amplitude waves, non-linear mechanisms that result in energy dissipation are suppressed by careful cavity design. However, high amplitude acoustic resonance has not been employed within disc-shaped cavities in which radial pressure oscillations are excited until recently. International Patent Application No. PCT/GB2006/001487, published as WO 2006/111775 (the '487 Application), discloses a pump having a substantially disc-shaped cavity with a high aspect ratio, i.e., the ratio of the radius of the cavity to the height of the cavity.

The pump described in the '487 application is further developed in related patent applications PCT/GB2009/050245, PCT/GB2009/050613, PCT/GB2009/050614, PCT/GB2009/050615, and PCT/GB2011/050141. These applications and the '487 Application are included herein by reference.

It is important to note that the pump described in the '487 application and the related applications listed above operates on a different physical principle to the majority of pumps described in the prior art. In particular, many pumps known in the art are displacement pumps, i.e. pumps in which the volume of the pumping chamber is made smaller in order to compress and expel fluids through an outlet valve and is increased in size so as to draw fluid through an inlet valve. An example of such a pump is described in DE4422743 ("Gerlach"), and further examples of displacement pumps may be found in US2004000843, WO2005001287, DE19539020, and U.S. Pat. No. 6,203,291.

By contrast, the '487 application describes a pump that applies the principle of acoustic resonance to motivate fluid through a cavity of the pump. In the operation of such a pump, pressure oscillations within the pump cavity compress fluid within one part of the cavity while expanding fluid in another part of the cavity. In contrast to the more conventional displacement pump, an acoustic resonance pump does not change the volume of the pump cavity in order to achieve pumping operation. Instead, the acoustic resonance pump's design is adapted to efficiently create, maintain, and rectify the acoustic pressure oscillations within the cavity.

Turning now to the design and operation of an acoustic resonance pump in greater detail, the '487 Application describes a pump having a substantially cylindrical cavity. The cylindrical cavity comprises a side wall closed at each end by end walls, one or more of which is a driven end wall. The pump also comprises an actuator that causes an oscillatory motion of the driven end wall (i.e., displacement oscillations) in a direction substantially perpendicular to the end wall or substantially parallel to the longitudinal axis of the cylindrical cavity. These displacement oscillations may be referred to hereinafter as axial oscillations of the driven end wall. The axial oscillations of the driven end wall generate substantially proportional pressure oscillations of fluid within the cavity. The pressure oscillations create a radial pressure distribution approximating that of a Bessel function of the first kind as described in the '487 Application. Such oscillations are referred to hereinafter as radial oscillations of the fluid pressure within the cavity.

The pump of the '487 application has one or more valves for controlling the flow of fluid through the pump. The valves are capable of operating at high frequencies, as it is preferable to operate the pump at frequencies beyond the range of human hearing. Such a valve is described in International Patent Application No. PCT/GB2009/050614.

The driven end wall is mounted to the side wall of the pump at an interface, and the efficiency of the pump is generally dependent upon this interface. It is desirable to maintain the efficiency of such a pump by structuring the interface so that it does not decrease or dampen the motion of the driven end wall, thereby mitigating a reduction in the amplitude of the fluid pressure oscillations within the cavity. Patent application PCT/GB2009/050613 (the '613 Application, incorporated by reference herein) discloses a pump wherein an actuator forms a portion of the driven end wall, and an isolator functions as the interface between actuator and the side wall. The isolator provides an interface that reduces damping of the motion of the driven end wall. Illustrative embodiments of isolators are shown in the figures of the '613 Application.

The pump of the '613 Application comprises a pump body having a substantially cylindrical shape defining a cavity formed by a side wall closed at both ends by substantially circular end walls. At least one of the end walls is a driven end wall having a central portion and a peripheral portion adjacent the side wall. The cavity contains a fluid when in use. The pump further comprises an actuator operatively associated with the central portion of the driven end wall to cause an oscillatory motion of the driven end wall in a direction substantially perpendicular thereto. The pump further comprises an isolator operatively associated with the peripheral portion of the driven end wall to reduce dampening of the displacement oscillations caused by the end wall's connection to the side wall of the cavity. The pump further comprises a first aperture disposed at about the center of one of the end walls, and a second aperture disposed at another location in the pump body, whereby the displacement oscillations generate radial oscillations of fluid pressure within the cavity of the pump body causing fluid flow through the apertures.

SUMMARY

A two-cavity disc pump is disclosed wherein each cavity is pneumatically isolated from the other so that each cavity may have a different valve configuration to provide different fluid dynamic capabilities. More specifically, a two-cavity disc pump having a single valve in one cavity and a bidirectional valve in the other cavity is disclosed that is capable of providing both high pressure and high flow rates.

One embodiment of such a pump has a pump body having pump walls substantially cylindrical in shape and having a side wall closed by two end walls for containing a fluid. The pump further comprises an actuator disposed between the two end walls and functioning as a first portion of a common end wall that forms a first cavity and a second cavity. The actuator is operatively associated with a central portion of the common end walls and adapted to cause an oscillatory motion of the common end walls thereby generating radial pressure oscillations of the fluid within both the first cavity and the second cavity.

The pump further comprises an isolator extending from the periphery of the actuator to the side wall as a second portion of the common wall that flexibly supports the actuator that separates the first cavity from the second cavity. A first aperture is disposed at a location in the end wall associated with the first cavity, and a second aperture is disposed at another location in the end wall associated with the first cavity. A first valve is disposed in either one of the first and second apertures to enable the fluid to flow through the first cavity in one direction. A third aperture is disposed at a location in the end wall associated with the second cavity with a bidirectional valve disposed therein to enable fluid to flow through the second cavity in both directions.

Other objects, features, and advantages of the illustrative embodiments are disclosed herein and will become apparent with reference to the drawings and detailed description that follow.

DETAILED DESCRIPTION OF ILLUSTRATIVE EMBODIMENTS

In the following detailed description of several illustrative embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

The present disclosure includes several possibilities for improving the functionality of an acoustic resonance pump. In operation, the illustrative embodiment of a single-cavity pump shown in FIG. 1A of the '613 Application may generate a net pressure difference across its actuator. The net pressure difference puts stress on the bond between the isolator and the pump body and on the bond between the isolator and the actuator component. It is possible that these stresses may lead to failure of one or more of these bonds, and it is desirable that the bonds should be strong in order to ensure that the pump delivers a long operational lifetime.

Further, in order to operate, the single-cavity pump shown in FIG. 1A of the '613 Application includes a robust electrical connection to the pump's actuator. The robust electrical connection may be achieved by, for example, including soldered wires or spring contacts that may be conveniently attached to the side of the actuator facing away from the pump cavity. However, as disclosed in the '417 Application, a resonant acoustic pump of this kind may also be designed such that two pump cavities are driven by a common driven end wall. A two-cavity pump may deliver increased flow and/or pressure when compared with a single-cavity design, and may deliver increased space, power, or cost efficiency. However, in a two-cavity pump it becomes difficult to make electrical contact to the actuator using conventional means without disrupting the acoustic resonance in at least one of the two pump cavities and/or mechanically dampening the motion of the actuator. For example, soldered wires or spring contacts may disrupt the acoustic resonance of the cavity in which they are present.

Therefore, for reasons of pump lifetime and performance, a pump construction that achieves a strong bond between the actuator and the isolator, and that facilitates robust electrical connection to the actuator without adversely affecting the resonance of either of the cavities of a two-cavity pump is desirable.

Figure 1:
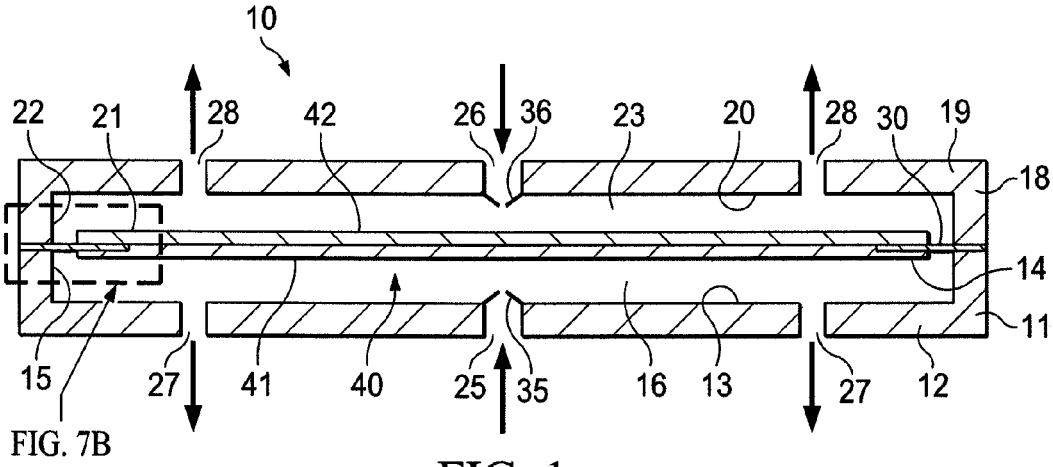
FIG. 1 shows a cross-section view of a two-cavity pump which includes a combined actuator and isolator assembly according to a first embodiment.
Figure 2:
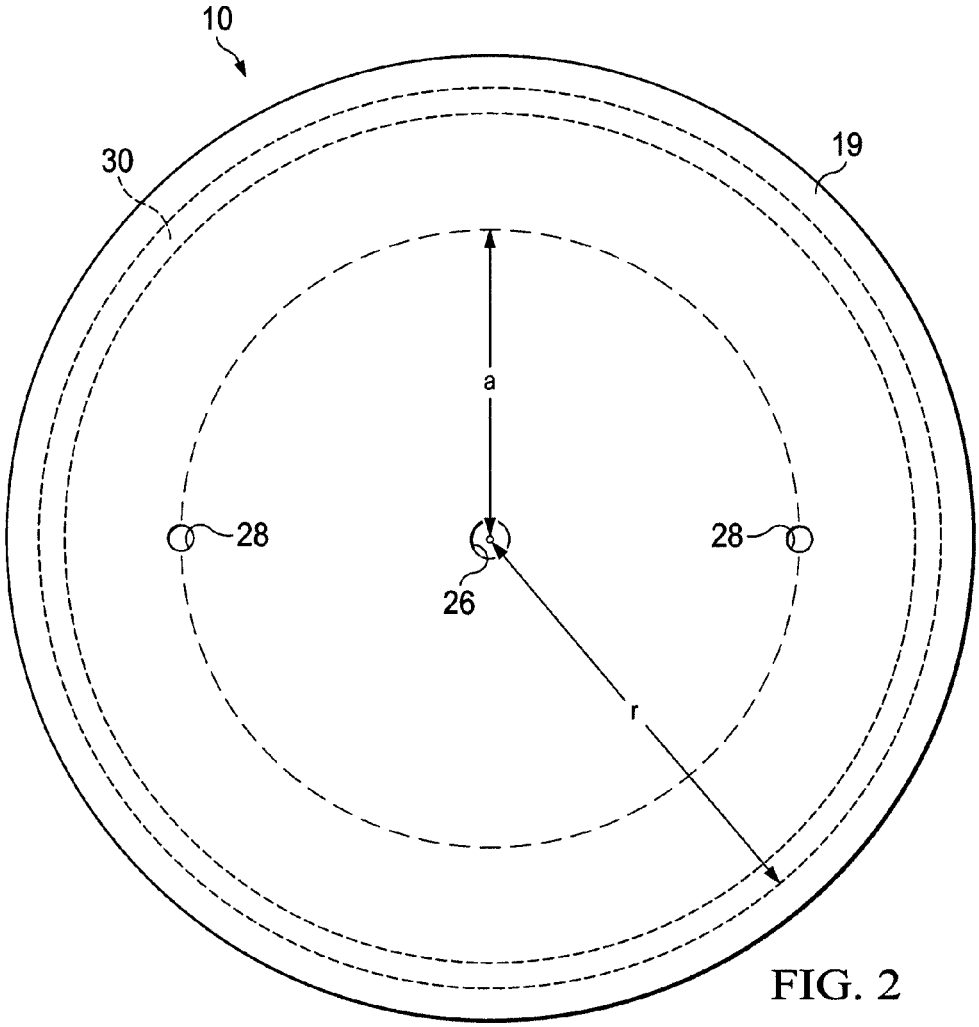
FIG. 2 shows a top view of the pump of FIG. 1.

Referring to FIGS. 1 and 2, a two-cavity pump 10 is shown according to one illustrative embodiment. Pump 10 comprises a first pump body having a substantially cylindrical shape including a cylindrical wall 11 closed at one end by a base 12 and closed at the other end by an end plate 41. An isolator 30, which may be a ring-shaped isolator, is disposed between the end plate 41 and the other end of the cylindrical wall 11 of the first pump body. The cylindrical wall 11 and base 12 may be a single component comprising the first pump body. Pump 10 also comprises a second pump body having a substantially cylindrical shape including a cylindrical wall 18 closed at one end by a base 19 and closed at the other end by a piezoelectric disc 42. The isolator 30 is disposed between the end plate 42 and the other end of the cylindrical wall 18 of the second pump body. The cylindrical wall 18 and base 19 may be a single component comprising the second pump body. The first and second pump bodies may be mounted to other components or systems.

The internal surfaces of the cylindrical wall 11, the base 12, the end plate 41, and the isolator 30 form a first cavity 16 within the pump 10 wherein the first cavity 16 comprises a side wall 15 closed at both ends by end walls 13 and 14. The end wall 13 is the internal surface of the base 12, and the side wall 15 is the inside surface of the cylindrical wall 11. The end wall 14 comprises a central portion corresponding to a surface of the end plate 41 and a peripheral portion corresponding to a first surface of the isolator 30. Although the first cavity 16 is substantially circular in shape, the first cavity 16 may also be elliptical or another shape. The internal surfaces of the cylindrical wall 18, the base 19, the piezoelectric disc 42, and the isolator 30 form a second cavity 23 within the pump 10 wherein the second cavity 23 comprises a side wall 22 closed at both ends by end walls 20 and 21. The end wall 20 is the internal surface of the base 19, and the side wall 22 is the inside surface of the cylindrical wall 18. The end wall 21 comprises a central portion corresponding to the inside surface of the piezoelectric disc 42 and a peripheral portion corresponding to a second surface of the isolator 30. Although the second cavity 23 is substantially circular in shape, the second cavity 23 may also be elliptical or another shape. The cylindrical walls 11, 18, and the bases 12, 19 of the first and second pump bodies may be formed from a suitable rigid material including, without limitation, metal, ceramic, glass, or plastic.

The piezoelectric disc 42 is operatively connected to the end plate 41 to form an actuator 40. In turn, the actuator 40 is operatively associated with the central portion of the end walls 14 and 21. The piezoelectric disc 42 may be formed of a piezoelectric material or another electrically active material such as, for example, an electrostrictive or magnetostrictive material. The end plate 41 preferably possesses a bending stiffness similar to the piezoelectric disc 42 and may be formed of an electrically inactive material such as a metal or ceramic. When the piezoelectric disc 42 is excited by an oscillating electrical current, the piezoelectric disc 42 attempts to expand and contract in a radial direction relative to the longitudinal axis of the cavities 16, 23 causing the actuator 40 to bend. The bending of the actuator 40 induces an axial deflection of the end walls 14, 21 in a direction substantially perpendicular to the end walls 14, 21. The end plate 41 may also be formed from an electrically active material such as, for example, a piezoelectric, magnetostrictive, or electrostrictive material.

The pump 10 further comprises at least two apertures extending from the first cavity 16 to the outside of the pump 10, wherein at least a first one of the apertures contains a valve to control the flow of fluid through the aperture. The aperture containing a valve may be located at a position in the cavity 16 where the actuator 40 generates a pressure differential as described below in more detail. One embodiment of the pump 10 comprises an aperture with a valve located at approximately the center of the end wall 13. The pump 10 comprises a primary aperture 25 extending from the cavity 16 through the base 12 of the pump body at about the center of the end wall 13 and containing a valve 35. The valve 35 is mounted within the primary aperture 25 and permits the flow of fluid in one direction as indicated by the arrow so that it functions as a fluid inlet for the pump 10. The term fluid inlet may also refer to an outlet of reduced pressure. The second aperture 27 may be located at a position within the cavity 11 other than the location of the aperture 25 having the valve 35. In one embodiment of the pump 10, the second aperture 27 is disposed between the center of the end wall 13 and the side wall 15. The embodiment of the pump 10 comprises two secondary apertures 27 extending from the cavity 11 through the base 12 that are disposed between the center of the end wall 13 and the side wall 15.

The pump 10 further comprises at least two apertures extending from the cavity 23 to the outside of the pump 10, wherein at least a first one of the apertures may contain a valve to control the flow of fluid through the aperture. The aperture containing a valve may be located at a position in the cavity 23 where the actuator 40 generates a pressure differential as described below in more detail. One embodiment of the pump 10 comprises an aperture with a valve located at approximately the center of the end wall 20. The pump 10 comprises a primary aperture 26 extending from the cavity 23 through the base 19 of the pump body at about the center of the end wall 20 and containing a valve 36. The valve 36 is mounted within the primary aperture 26 and permits the flow of fluid in one direction as indicated by the arrow so that it functions as a fluid inlet for the pump 10. The term fluid inlet may also refer to an outlet of reduced pressure. The second aperture 28 may be located at a position within the cavity 23 other than the location of the aperture 26 having the valve 36. In one embodiment of the pump 10, the second aperture 28 is disposed between the center of the end wall 20 and the side wall 22. The embodiment of the pump 10 comprises two secondary apertures 28 extending from the cavity 23 through the base 19 that are disposed between the center of the end wall 20 and the side wall 22.

Although valves are not shown in the secondary apertures 27, 28 in the embodiment of the pump 10 shown in FIG. 1, the secondary apertures 27, 28 may include valves to improve performance if necessary. In the embodiment of the pump 10 of FIG. 1, the primary apertures 25, 26 include valves so that fluid is drawn into the cavities 16, 23 of the pump 10 through the primary apertures 25, 26 and pumped out of the cavities 16, 23 through the secondary apertures 27, 28 as indicated by the arrows. The resulting flow provides a negative pressure at the primary apertures 25, 26. As used herein, the term reduced pressure generally refers to a pressure less than the ambient pressure where the pump 10 is located. Although the terms vacuum and negative pressure may be used to describe the reduced pressure, the actual pressure reduction may be significantly less than the pressure reduction normally associated with a complete vacuum. The pressure is negative in the sense that it is a gauge pressure, i.e., the pressure is reduced below ambient atmospheric pressure. Unless otherwise indicated, values of pressure stated herein are gauge pressures.

References to increases in reduced pressure typically refer to a decrease in absolute pressure, while decreases in reduced pressure typically refer to an increase in absolute pressure.

The valves 35 and 36 allow fluid to flow through in substantially one direction as described above. The valves 35 and 36 may be a ball valve, a diaphragm valve, a swing valve, a duck-bill valve, a clapper valve, a lift valve, or another type of check valve or valve that allows fluid to flow substantially in only one direction. Some valve types may regulate fluid flow by switching between an open and closed position. For such valves to operate at the high frequencies generated by the actuator 40, the valves 35 and 36 must have an extremely fast response time such that they are able to open and close on a timescale significantly shorter than the timescale of the pressure variation. One embodiment of the valves 35 and 36 achieves this by employing an extremely light flap valve which has low inertia and consequently is able to move rapidly in response to changes in relative pressure across the valve structure.

Figure 3:
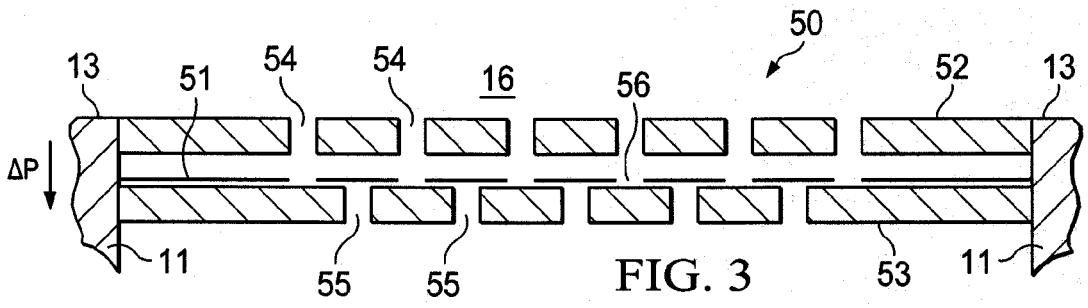
FIG. 3 shows a cross-section view of a valve for use with the pump of FIG. 1.
Figure 3A:
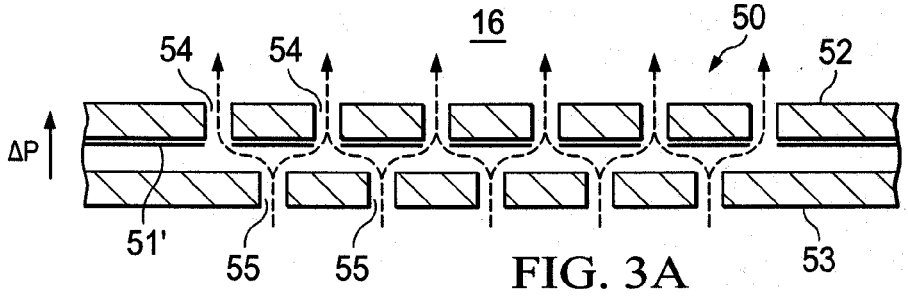
FIGS. 3A and 3B show a section of the valve of FIG. 3 in operation.
Figure 3B:
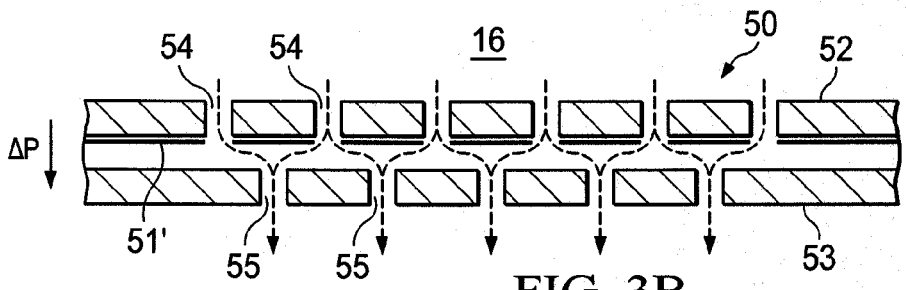
Figure 4:
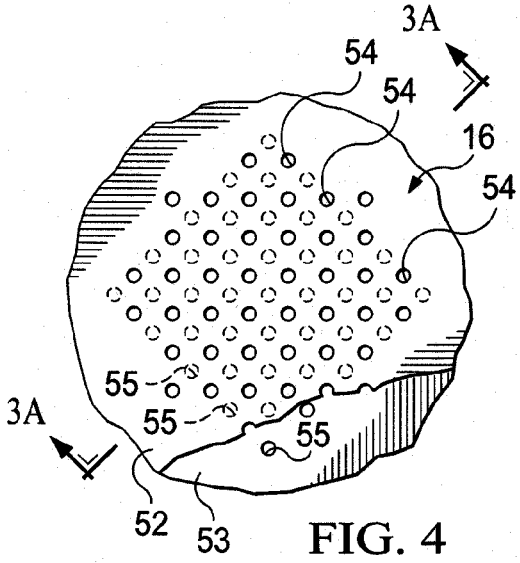
FIG. 4 shows a partial top view of the valve of FIG. 3.

Referring more specifically to FIGS. 3 and 4, one embodiment of a flap valve 50 is shown mounted within the aperture 25. The flap valve 50 comprises a flap 51 disposed between a retention plate 52 and a sealing plate 53. The flap 51 is biased against the sealing plate 53 in a closed position which seals the flap valve 50 when not in use, i.e., the flap valve 50 is normally closed. The valve 50 is mounted within the aperture 25 so that the upper surface of the retention plate 52 is preferably flush with the end wall 13 to maintain the resonant quality of the cavity 16. The retention plate 52 and the sealing plate 53 both have vent holes 54 and 55, respectively, which extend from one side of the plate to the other as represented by the dashed and solid circles, respectively, in FIG. 4. The flap 51 also has vent holes 56 that are generally aligned with the vent holes 54 of the retention plate 52 to provide a passage through which fluid may flow as indicated by the dashed arrows in FIGS. 3A and 3B. However, as can be seen in FIGS. 3A and 3B, the vent holes 54 of the retention plate 52 and the vent holes 56 of the flap 51 are not in alignment with the vent holes 55 of the sealing plate 53. The vent holes 55 of the sealing plate 53 are blocked by the flap 51 so that fluid cannot flow through the flap valve 50 when the flap 51 is in the closed position as shown in FIG. 3.

The operation of the flap valve 50 is a function of the change in direction of the differential pressure ($\Delta P$) of the fluid across the flap valve 50. In FIG. 3, the differential pressure has been assigned a negative value ($-\Delta P$) as indicated by the downward pointing arrow. This negative differential pressure ($-\Delta P$) drives the flap 51 into the fully closed position, as described above, wherein the flap 51 is sealed against the sealing plate 53 to block the vent holes 55 and prevent the flow of fluid through the flap valve 50. When the differential pressure across the flap valve 50 reverses to become a positive differential pressure ($+\Delta P$) as indicated by the upward pointing arrow in FIG. 3A, the biased flap 51 is motivated away from the sealing plate 53 against the retention plate 52 into an open position. In the open position, the movement of the flap 51 unblocks the vent holes 55 of the sealing plate 53 so that fluid is permitted to flow through vent holes 55, the aligned vent holes 56 of the flap 51, and the vent holes 54 of the retention plate 52 as indicated by the dashed arrows. When the differential pressure changes back to a negative differential pressure ($-\Delta P$), as indicated by the downward pointing arrow in FIG. 3B, fluid begins flowing in the opposite direction through the flap valve 50, as indicated by the dashed arrows, which forces the flap 51 back toward the closed position shown in FIG. 3. Thus, the changing differential pressure cycles the flap valve 50 between the open and the closed positions to block the flow of fluid by closing the flap 51 when the differential pressure changes from a positive to a negative value. It should be understood that flap 51 could be biased against the retention plate 52 in an open position when the flap valve 50 is not in use depending upon the application of the flap valve 50, i.e., the flap valve 50 would then be normally open.

Figure 5A:
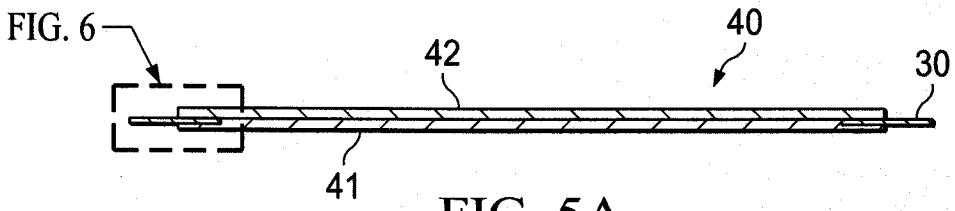
FIG. 5A shows a cross-section of a combined actuator and isolator assembly for use with the pump of FIG. 1.
Figure 5B:
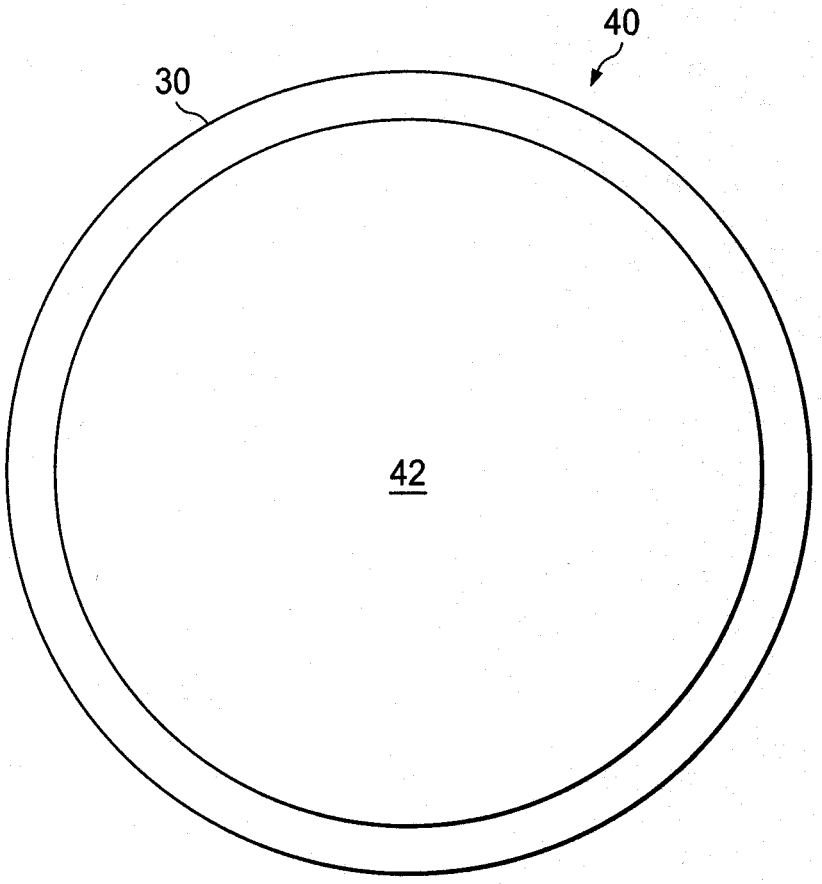
FIG. 5B shows a plan view of the combined actuator and isolator assembly of FIG. 5A.

Turning now to the detailed construction of the combined actuator and isolator, FIGS. 5A and 5B show cross-section views of the combined actuator 40 and the isolator 30 according to the present invention. The isolator 30 is sandwiched between the piezoelectric disc 42 and the end plate 41 to form a subassembly. The bonds between the isolator 30, the end plate 41, and the piezoelectric disc 42 may be formed by a suitable method including, without limitation, gluing. The fact that the isolator 30 is held between the piezoelectric disc 42 and the end plate 41 makes the connection between the isolator and these two parts extremely strong, which is necessary where there may be a pressure difference across the assembly as described earlier herein.

Figure 6:
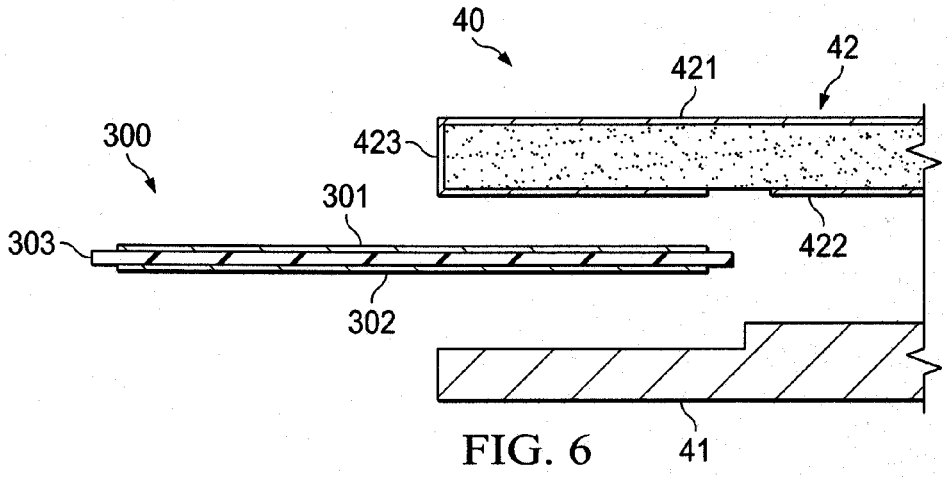
FIG. 6 shows an exploded cross section view in detail of the combined actuator and isolator assembly of FIG. 5.

FIG. 6 shows a magnified view of the edge of the combined actuator 40 and the isolator 30 of the pump 10 that provides for electrical connection to be made to the actuator 40 by integrating electrodes into the isolator 30 and actuator 40. In the illustrated embodiment, the isolator 30 may comprise an isolator 300. The actuator 40 includes the piezoelectric disc 42 that has a first actuator electrode 421 on an upper surface and a second actuator electrode 422 on a lower surface. Both the first actuator electrode 421 and the second actuator electrode 422 are metal. The first actuator electrode 421 is wrapped around the edge of the actuator 40 in at least one location around the circumference of the actuator 40 to bring a portion of the first actuator electrode 421 onto the lower surface of the piezoelectric disc 42. This wrapped portion of the first actuator electrode 421 is a wrap electrode 423. In operation, a voltage is applied across the first actuator electrode 421 and second actuator electrode 422 resulting in an electric field being set up between the electrodes in a substantially axial direction. The piezoelectric disc 42 is polarized such that the axial electric field causes the piezoelectric disc 42 to expand or contract in a radial direction depending on the polarity of the electric field applied. In operation, no electric field is created between the first actuator electrode 421 and the wrap electrode 423 that extends over a portion of the surface of the piezoelectric disc 42 that opposes the first actuator electrode 421. Thus, the area over which the axial field is created is limited to the area of the piezoelectric disc 42 that does not include the wrap electrode 423. For this reason, the wrap electrode 423 may not extend over a significant part of the lower surface of the piezoelectric disc 42. In addition, it is noted that while FIG. 6 shows a piezoelectric disc 42 situated above the end plate 41, the positions of these elements may be altered in an another embodiment. In such an embodiment, the piezoelectric disc 42 may be assembled below the end plate 41, and the second actuator electrode 422 may reside on the upper surface of the piezoelectric disc 42. Correspondingly, the first actuator electrode 421 may reside on the lower surface of the piezoelectric disc 42, and the wrap electrode 423 may extend around the edge of the piezoelectric disc 42 to cover a portion of the upper surface of the piezoelectric disc 42.

The isolator 300 is comprised of a flexible, electrically non-conductive core 303 with conductive electrodes on its upper and lower surfaces. The upper surface of the isolator 300 includes a first isolator electrode 301 and the lower surface of the isolator 300 includes a second isolator electrode 302. The first isolator electrode 301 connects with the wrap electrode 423 and thereby with the first actuator electrode 421 of the piezoelectric disc 42. The second isolator electrode 302 connects with the end plate 41 and thereby with the second actuator electrode 422 of the piezoelectric disc 42. In this case, the end plate 41 should be formed from an electrically conductive material. In an exemplary embodiment, the actuator 40 comprises a steel end plate 41 of between about 5 mm and about 20 mm radius and between about 0.1 mm and about 3 mm thickness bonded to a piezoceramic piezoelectric disc 42 of similar dimensions. The isolator core 303 is a formed from polyimide with a thickness of between about 5 microns and about 200 microns. The first and second isolator electrodes 301, 302 are formed from copper layers having a thickness of between about 3 microns and about 50 microns. In the exemplary embodiment, the actuator 40 comprises a steel end plate 41 of about 10 mm radius and about 0.5 mm thickness bonded to a piezoceramic disc 42 of similar dimensions. The isolator core 303 is formed from polyimide with a thickness of about 25 microns. The first and second isolator electrodes 301, 302 are formed from copper having a thickness of about 9 microns. Further capping layers of polyimide (not shown) may be applied selectively to the isolator 300 to insulate the first and second isolator electrodes 301, 302 and to provide robustness.

Figure 7:
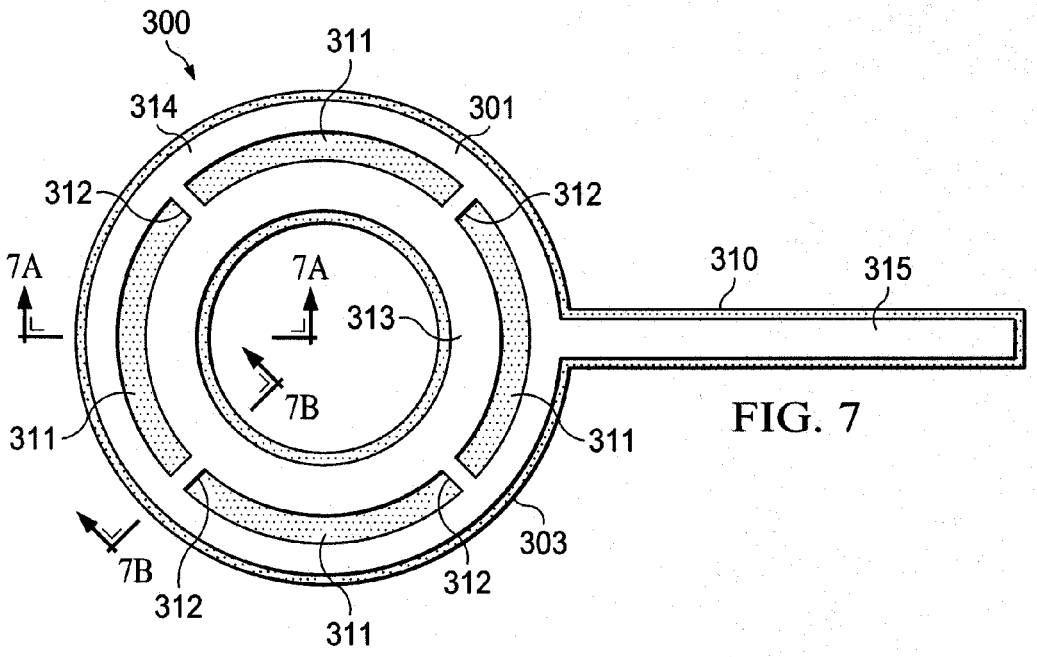
FIG. 7 shows a detailed plan view of the isolator of the actuator assembly of FIG. 6.

FIG. 7 shows a plan view of the isolator 300 included in FIG. 6 as a possible configuration of the first isolator electrode 301 as an electrode layer. The first isolator electrode 301 has a ring-shaped portion that includes an inner ring portion 313 and an outer ring portion 314 that are connected by spoke members 312. The isolator electrode 301 also includes a tab portion or tail 310 extending from the outer ring portion 314 of the ring-shaped portion. The ring-shaped portion is circumferentially patterned with windows 311 having an arcuate shape that extend around the perimeter of the ring-shaped portion to form the inner ring portion 313 and outer ring portion 314. The windows 311 are separated from one another by the spoke members 312 that extend axially between the inner ring portion 313 and the outer ring portion 314.

In one embodiment, the electrode layer that forms the first isolator electrode 301 is a copper layer formed adjacent a polyimide layer, as described above. The second isolator electrode 302 may be formed from a second electrode layer that is adjacent the side of the polyimide layer that opposes the first electrode layer. In this embodiment, the first isolator electrode 301 is patterned to leave the windows 311 in the electrode layer that forms the first isolator electrode 301. The windows 311 provide an area where the isolator 300 flexes more freely between the outside edge of the actuator 40 and the inside edge of the pump bases 11 and 18. These windows 311 locally reduce the stiffness of the isolator 300, enabling the isolator 300 to bend more readily, thereby reducing a damping effect that the electrode layer might otherwise have on the motion of the actuator 40. The inner ring portion 313 of the first isolator electrode 301 enables connection to the wrap electrode 423 of the piezoelectric disc 42. The inner ring portion 313 is connected to the outer ring portion 314 by four spoke members 312. A further part 315 of the electrode 301 extends along the tail 310 to facilitate connection of the pump 10 to a drive circuit. The second isolator electrode 302 may be similarly configured.

Figure 7A:
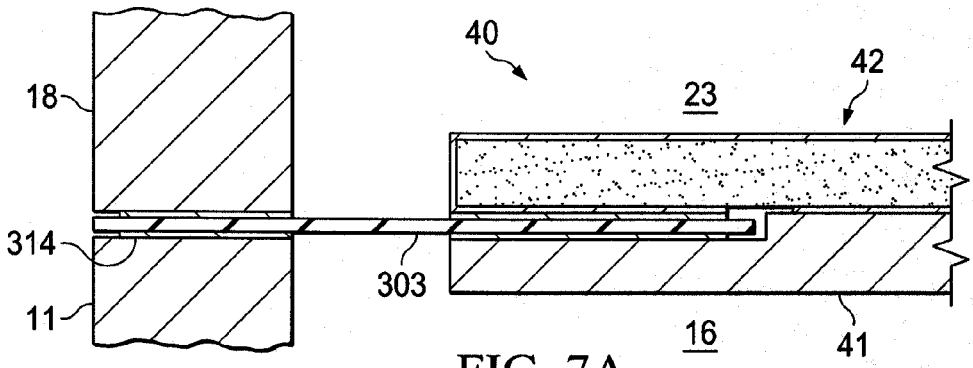
FIGS. 7A and 7B are cross-section views taken along the lines 7A-7A and 7B-7B, respectively of FIG. 7.
Figure 7B:
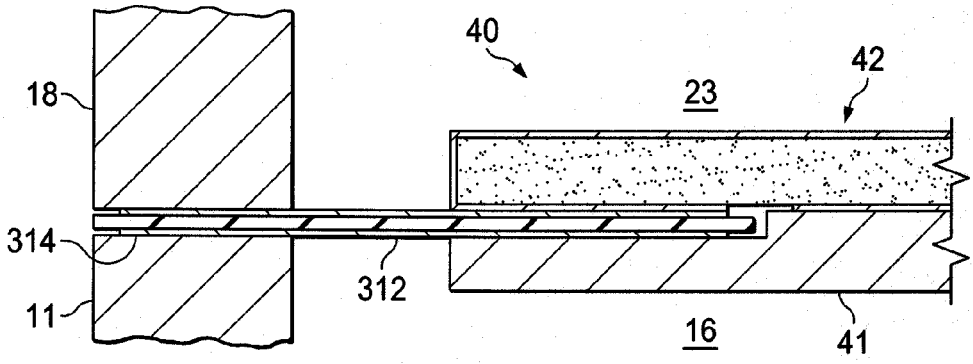

FIGS. 7A and 7B show cross-sections through the combined actuator 40 and the isolator 300 assembly shown in FIG. 7, including mounting of the isolator 300 between the cylindrical wall 11 and the cylindrical wall 18. FIG. 7A shows a section through a region including a window 311. FIG. 7B shows a section through a region including a spoke member 312. The isolator 300 may be glued, welded, clamped, or otherwise attached to the cylindrical wall 11 and the cylindrical wall 18. The isolator 300 comprising the core 303, the first and second isolator electrodes 301 and 302, and further capping layers (not shown) may be conveniently formed using flexible printed circuit board manufacturing techniques in which copper (or other conductive material) tracks are formed on a Kapton (or other flexible non-conductive material) polyimide substrate. Such processes are capable of producing parts with the dimensions listed above.

In one non-limiting example, the diameter of the piezoelectric disc 42 and the end plate 41 may be 1-2 mm less than the diameter of the cavities 16 and 23 such that the isolator 30 spans the peripheral portion of the end walls 14 and 21. The peripheral portion may be an annular gap of about 0.5 mm to about 1.0 mm between the edge of the actuator 40 and the side walls 15 and 22 of the cavities 16 and 23, respectively. Generally, the annular width of this gap should be relatively small compared to the cavity radius (r) such that the diameter of the actuator 40 is close to the diameter of the cavities 16, 23 so that the diameter of an annular displacement node 47 (not shown) is approximately equal to the diameter of an annular pressure node 57 (not shown), while being large enough to facilitate and not restrict the vibrations of the actuator 40. The annular displacement node 47 and the annular pressure node 57 are described in more detail with respect to FIGS. 8, 8A, and 8B.

Figure 8:
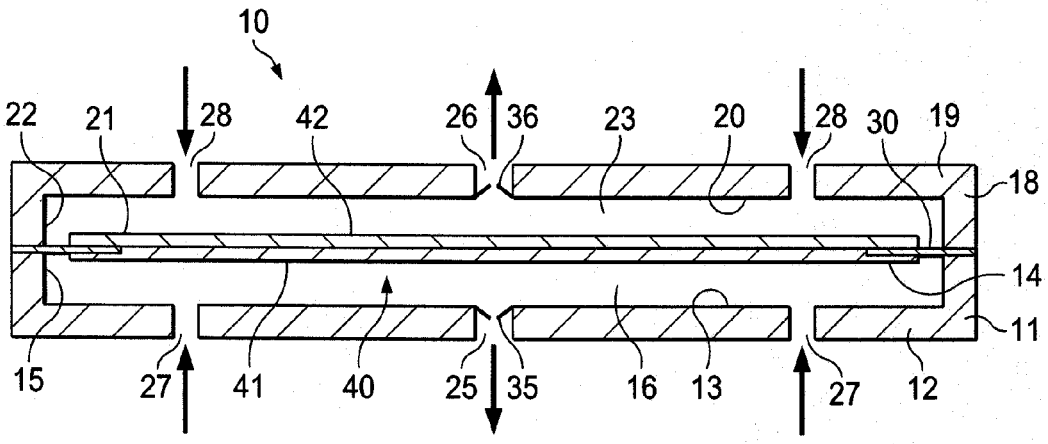
FIG. 8 shows the two-cavity pump of FIG. 1 with reference to the operational graphs of FIGS. 8A and 8B.
Figure 8A:
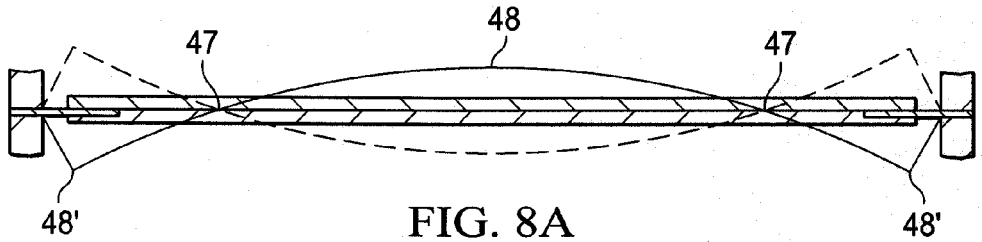
FIGS. 8A and 8B show, respectively, a graph of the displacement oscillations of the driven end wall of the pump, and a graph of the pressure oscillations within the cavity of the pump of FIG. 1.
Figure 8B:
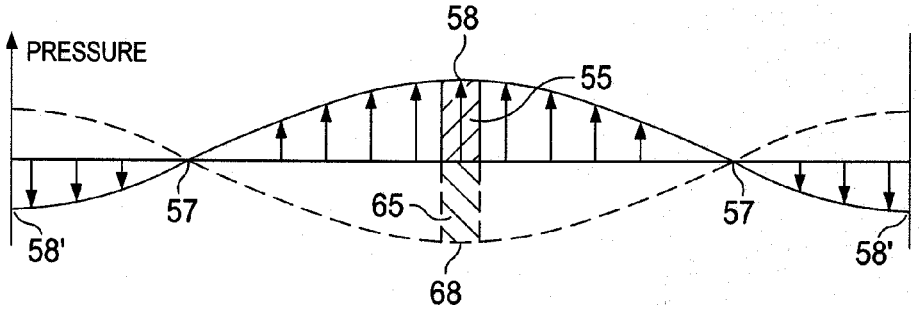

Referring now to FIGS. 8, 8A, and 8B, during operation of the pump 10, the piezoelectric disc 42 is excited to expand and contract in a radial direction against the end plate 41, which causes the actuator 40 to bend, thereby inducing an axial displacement of the driven end walls 14, 21 in a direction substantially perpendicular to the driven end walls 14, 21. The actuator 40 is operatively associated with the central portion of the end walls 14, 21, as described above, so that the axial displacement oscillations of the actuator 40 cause axial displacement oscillations along the surface of the end walls 14, 21 with maximum amplitudes of oscillations, i.e., anti-node displacement oscillations, at about the center of the end walls 14, 21. The displacement oscillations and the resulting pressure oscillations of the pump 10 are shown more specifically in FIGS. 8A and 8B, respectively. The phase relationship between the displacement oscillations and the pressure oscillations may vary, and a particular phase relationship should not be implied from a figure.

FIG. 8A shows one possible displacement profile illustrating the axial oscillation of the driven end walls 14, 21 of the cavities 16, 23. The solid curved line and arrows represent the displacement of the driven end walls 14, 21 at one point in time, and the dashed curved line represents the displacement of the driven end walls 14, 21 one half-cycle later. The displacement as shown in FIGS. 8A and 8B is exaggerated. Because the actuator 40 is not rigidly mounted at its perimeter, but rather suspended by the isolator 30, the actuator 40 is free to oscillate about its center of mass in its fundamental mode. In this fundamental mode, the amplitude of the displacement oscillations of the actuator 40 is substantially zero at the annular displacement node 47 located between the center of the end walls 14, 21 and the corresponding side walls 15, 22. The amplitudes of the displacement oscillations at other points on the end walls 14, 21 have amplitudes greater than zero as represented by the vertical arrows. A central displacement anti-node 48 exists near the center of the actuator 40, and a peripheral displacement anti-node 48' exists near the perimeter of the actuator 40.

FIG. 8B shows one possible pressure oscillation profile illustrating the pressure oscillations within the cavities 16, 23 resulting from the axial displacement oscillations shown in FIG. 8A. The solid curved line and arrows represent the pressure at one point in time, and the dashed curved line represents the pressure one half-cycle later. In this mode and higher-order modes, the amplitude of the pressure oscillations has a central pressure anti-node 58 near the center of the cavities 16, 23, and a peripheral pressure anti-node 58' near the side walls 15, 22 of the cavities 16, 23. The amplitude of the pressure oscillations is substantially zero at the annular pressure node 57 between the pressure anti-nodes 58 and 58'. For a cylindrical cavity, the radial dependence of the amplitude of the pressure oscillations in the cavities 16, 23 may be approximated by a Bessel function of the first kind. The pressure oscillations described above result from the radial movement of the fluid in the cavities 16, 23, and so will be referred to as radial pressure oscillations of the fluid within the cavities 16, 23 as distinguished from the axial displacement oscillations of the actuator 40.

With reference to FIGS. 8A and 8B, it can be seen that the radial dependence of the amplitude of the axial displacement oscillations of the actuator 40 (the mode-shape of the actuator 40) should approximate a Bessel function of the first kind so as to match more closely the radial dependence of the amplitude of the desired pressure oscillations in the cavities 16, 23 (the mode-shape of the pressure oscillation). By not rigidly mounting the actuator 40 at its perimeter and allowing the actuator 40 to vibrate more freely about its center of mass, the mode-shape of the displacement oscillations substantially matches the mode-shape of the pressure oscillations in the cavities 16, 23, achieving mode-shape matching or, more simply, mode-matching. Although the mode-matching may not always be perfect in this respect, the axial displacement oscillations of the actuator 40 and the corresponding pressure oscillations in the cavities 16, 23 have substantially the same relative phase across the full surface of the actuator 40, wherein the radial position of the annular pressure node 57 of the pressure oscillations in the cavities 16, 23 and the radial position of the annular displacement node 47 of the axial displacement oscillations of actuator 40 are substantially coincident.

As indicated above, the operation of the valve 50 is a function of the change in direction of the differential pressure (ΔP) of the fluid across the valve 50. The differential pressure (ΔP) is assumed to be substantially uniform across the entire surface of the retention plate 52. This is assumed because (i) the diameter of the retention plate 52 is small relative to the wavelength of the pressure oscillations in the cavities 16 and 23, and (ii) the valve 50 is located near the center of the cavities where the amplitude of the positive central pressure anti-node 58 is relatively constant. Referring to FIG. 8B, a positive square-shaped portion 55 of the positive central pressure anti-node 58 shows the relative constancy. A negative square-shaped portion 65 of the negative central pressure anti-node 68 also illustrates the relative constancy. Therefore, there is virtually no spatial variation in the pressure across the center portion of the valve 50.

Figures 9A, 9B, 9C:
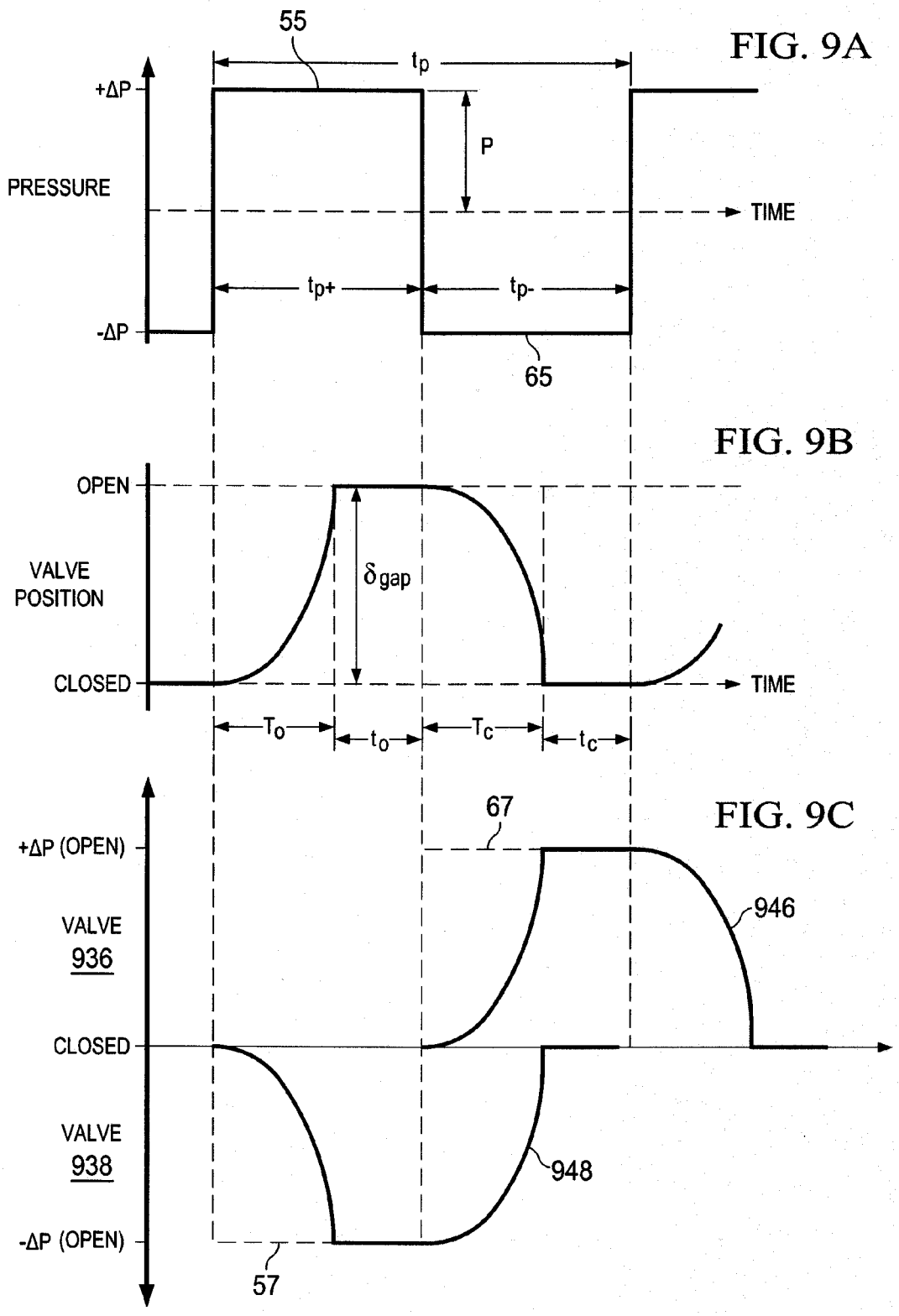
FIG. 9A shows a graph of an oscillating differential pressure applied across the valves of the pump of FIG. 1 according to an illustrative embodiment.
FIG. 9B shows a graph of an operating cycle of the one-directional valve used in the pump of FIG. 1 moving between an open and closed position.
FIG. 9C shows a graph of an operating cycle of the bidirectional valve used in the pump of FIG. 11 moving between an open and closed position.

FIG. 9A further illustrates the dynamic operation of the valve 50 when it is subject to a differential pressure that varies in time between a positive value (+ΔP) and a negative value (−ΔP). While in practice the time-dependence of the differential pressure across the valve 50 may be approximately sinusoidal, the time-dependence of the differential pressure across the valve 50 is approximated as varying in the square-wave form shown in FIG. 9A to facilitate explanation of the operation of the valve 50. The positive differential pressure 55 is applied across the valve 50 over the positive pressure time period ($t_{p+}$), and the negative differential pressure 65 is applied across the valve 50 over the negative pressure time period ($t_{p-}$) of the square wave. FIG. 9B illustrates the motion of the flap 51 in response to this time-varying pressure. As differential pressure (ΔP) switches from negative 65 to positive 55 the valve 50 begins to open and continues to open over an opening time delay ($T_o$) until the valve flap 51 meets the retention plate 52 as also described above and as shown by the graph in FIG. 9B. As differential pressure (ΔP) subsequently switches back from positive differential pressure 55 to negative differential pressure 65, the valve 50 begins to close and continues to close over a closing time delay ($T_c$) as also described above and as shown in FIG. 9B.

The dimensions of the pumps described herein should preferably satisfy certain inequalities with respect to the relationship between the height (h) of the cavities 16 and 23 and the radius (r) of the cavities 16 and 23. The radius (r) is the distance from the longitudinal axis of the cavity to its respective side wall 15, 22. These equations are as follows:

$$r/h>1.2;\text{ and}$$

$$h^2/r>4\times10^{-10}\text{ meters.}$$

In one exemplary embodiment, the ratio of the cavity radius to the cavity height (r/h) is between about 10 and about 50 when the fluid within the cavities 16, 23 is a gas. In this example, the volume of the cavities 16, 23 may be less than about 10 ml. Additionally, the ratio of $h^2/r$ is preferably within a range between about $10^{-3}$ and about $10^{-6}$ meters where the working fluid is a gas as opposed to a liquid.

In one exemplary embodiment, the secondary apertures 27, 28 (FIG. 1) are located where the amplitude of the pressure oscillations within the cavities 16, 23 is close to zero, i.e., the nodal points 47, 57 of the pressure oscillations as indicated in FIG. 8B. Where the cavities 16, 23 are cylindrical, the radial dependence of the pressure oscillation may be approximated by a Bessel function of the first kind. The radial node of the lowest-order pressure oscillation within the cavity occurs at a distance of approximately 0.63r±0.2r from the center of the end walls 13, 20 or the longitudinal axis of the cavities 16, 23. Thus, the secondary apertures 27, 28 are preferably located at a radial distance (a) from the center of the end walls 13, 20, where (a)≈0.63r±0.2r, i.e., close to the nodal points of the pressure oscillations 57.

Additionally, the pumps disclosed herein should preferably satisfy the following inequality relating the cavity radius (r) and operating frequency (f), which is the frequency at which the actuator 40 vibrates to generate the axial displacement of the end walls 14, 21. The inequality equation is as follows:

$$\frac{k_0(c_s)}{2\pi f} \le r \le \frac{k_0(c_f)}{2\pi f}.$$

The speed of sound in the working fluid within the cavities 16, 23, (c) may range between a slow speed ($c_s$) of about 115 m/s and a fast speed ($c_f$) equal to about 1,970 m/s as expressed in the equation above, and $k_0$ is a constant ($k_0$=3.83). The frequency of the oscillatory motion of the actuator 40 is preferably about equal to the lowest resonant frequency of radial pressure oscillations in the cavities 16, 23, but may be within 20% therefrom. The lowest resonant frequency of radial pressure oscillations in the cavities 16, 23 is preferably greater than 500 Hz.

Figure 10B:
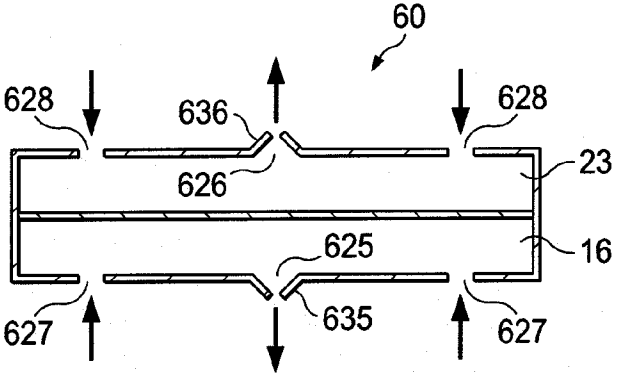
FIGS. 10A, 10B, 10C, and 10D show schematic, cross-sections of embodiments of two-cavity pumps having various inlet and outlet configurations.
Figure 10A:
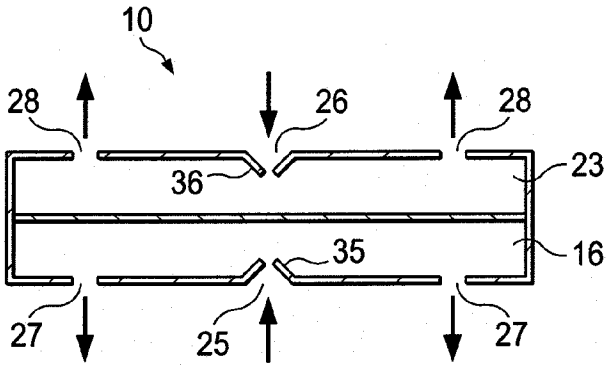

FIG. 10A shows the pump 10 of FIG. 1 in schematic form, indicating the locations of the inlet apertures 25 and 26 and outlet apertures 27 and 28 of the two cavities 16 and 23, together with the valves 35 and 36 located in the apertures 25 and 26 respectively. FIG. 10B shows an alternative configuration of a two-cavity pump 60 in which the valves 635 and 636 in the primary apertures 625 and 626 of pump 60 are reversed so that the fluid is expelled out of the cavities 16 and 23 through the primary apertures 625 and 626 and drawn into the cavities 16 and 23 through the secondary apertures 627 and 628 as indicated by the arrows, thereby providing a source of positive pressure at the primary apertures 625 and 626.

Figure 10D:
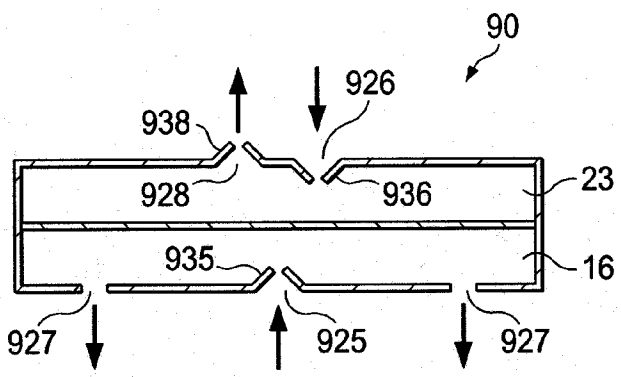
Figure 10C:
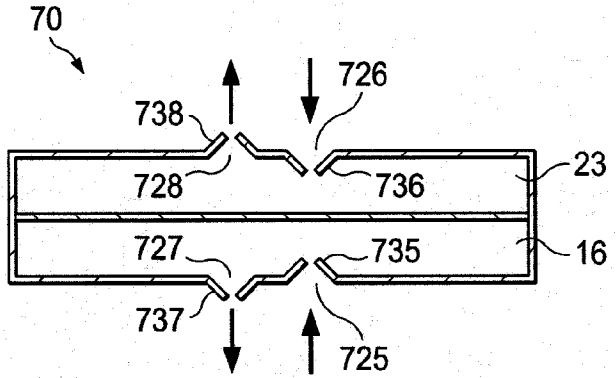

FIG. 10C shows another configuration of a two-cavity pump 70 in which both the primary and secondary apertures in the cavities 16 and 23 of the pump 70 are located close to the centers of the end walls of the cavities. In this configuration both the primary and secondary apertures are valved as shown so that the fluid is drawn into the cavities 16 and 23 through the primary apertures 725 and 726 and expelled out of the cavities 16 and 23 through the secondary apertures 727 and 728. A benefit of the two-valve configuration, shown schematically in FIG. 10C, is that the two valve configuration can enable full-wave rectification of the pressure oscillations in the cavities 16 and 23. The configurations shown in FIGS. 10A and 10B are able to deliver only half-wave rectification. Thus, the pump 70 is able to deliver a higher differential pressure than the pumps 10 and 60 under the same drive conditions, whereas the pumps 10 and 60 are able to deliver higher flow rates the pump 70. It is desirable for some applications to use a two-cavity pump that has both high pressure and high flow rate capabilities.

FIG. 10D shows a further alternative configuration of a two-cavity, hybrid pump 90, wherein the cavity 16 has primary and secondary apertures 925 and 927 with a valve 935 positioned within the primary aperture 925 in a fashion similar to the configuration of the cavity 16 of the pump 10 in FIG. 10A. The cavity 23 has primary and secondary apertures 926 and 928 with valves 936 and 938 positioned in a respective aperture in a configuration similar to the configuration of the cavity 23 of the pump 70 in FIG. 10C. Thus, the hybrid pump 90 is capable of providing both higher pressures and higher flow rates when needed by a specific application. The two cavities 16 and 23 may be connected in series or parallel in order to deliver increased pressure or increased flow, respectively, through the use of an appropriate manifold device. Such manifold device may be incorporated into the cylindrical wall 11, the base 12, the cylindrical wall 18, and the base 19 to facilitate assembly and to reduce the number of parts required in order to assemble the pump 10.

One application, for example, is using a hybrid pump for wound therapy. Hybrid pump 90 is useful for providing negative pressure to the manifold used in a dressing for wound therapy where the dressing is positioned adjacent the wound and covered by a drape that seals the negative pressure within the wound site. When the primary apertures 925 and 926 are both at ambient pressure and the actuator 40 begins vibrating and generating pressure oscillations within the cavities 16 and 23 as described above, air begins flowing alternatively through the valves 935 and 936 causing air to flow out of the secondary apertures 927 and 928 such that the hybrid pump 90 begins operating in a "free-flow" mode. As the pressure at the primary apertures 925 and 926 increases from ambient pressure to a gradually increasing negative pressure, the hybrid pump 90 ultimately reaches a maximum target pressure at which time the air flow through the two cavities 16 and 23 is negligible, i.e., the hybrid pump 90 is in a "stall condition" with no air flow. Increased flow rates from the cavity 16 of the hybrid pump 90 are needed for two therapy conditions. First, high flow rates are needed to initiate the negative pressure therapy in the free-flow mode so that the dressing is evacuated quickly, causing the drape to create a good seal over the wound site and maintain the negative pressure at the wound site. Second, after the pressure at the primary apertures 925 and 926 reach the maximum target pressure such that the hybrid pump 90 is in the stall condition, high flow rates are again needed maintain the target pressure in the event that the drape or dressing develops a leak to weaken the seal.

Figure 11:
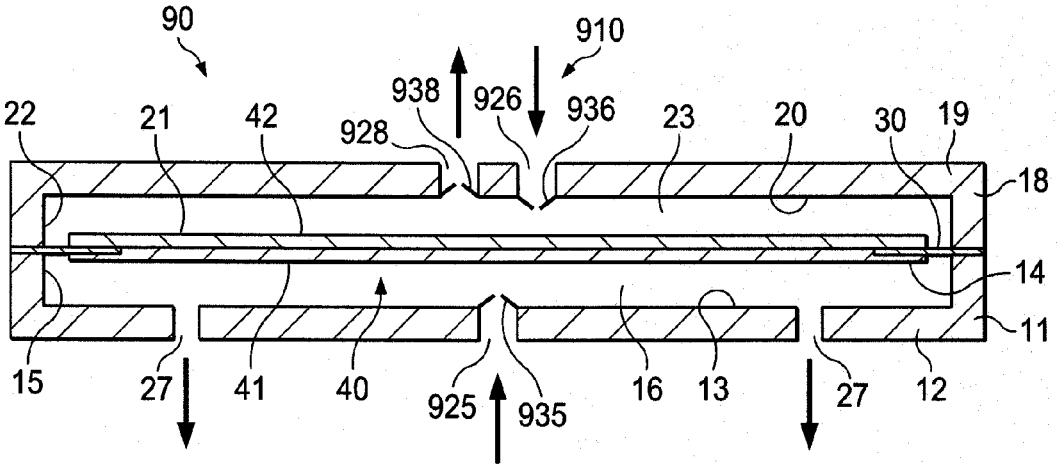
FIG. 11 shows a cross-section view of a two-cavity pump that includes a combined actuator isolator assembly similar to the pump of FIG. 1 and the valve structure arrangement of the pump of FIG. 10D.
Figure 12:
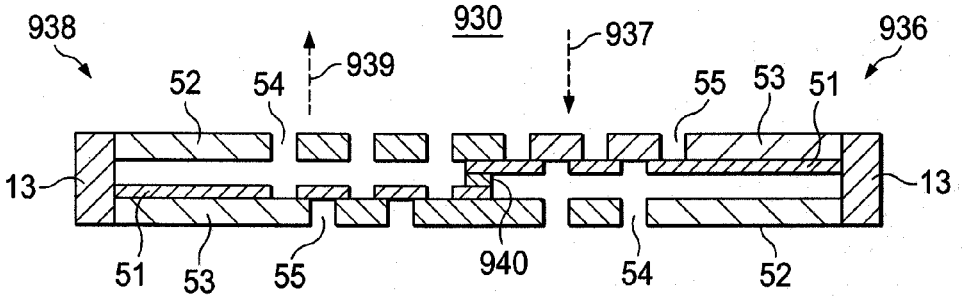
FIG. 12 shows a cross-section view of a bidirectional valve used in the pump of FIG. 11 and having two valve portions that allow fluid flow in opposite directions.

Referring now to FIG. 11, the hybrid pump 90 is shown in greater detail. As indicated above, the hybrid pump 90 is substantially similar to the pump 10 shown in FIG. 1 as described in more detail below. The hybrid pump 90 includes the dual-the valve structure having valves 936 and 938 that permit airflow in opposite directions as described above with respect to FIG. 10D. Valves 936 and 938 both function in a manner similar to valves 35 and 36, as described above. More specifically, valves 936 and 938 function similar to valve 50 as described with respect to FIGS. 3, 3A, and 3B. The valves 936 and 938 may be structured as a single bidirectional valve 930 as shown in FIG. 12. The two valves 936 and 938 share a common wall or dividing barrier 940, although other constructions may be possible. When the differential pressure across the valve 938 is initially negative and reverses to become a positive differential pressure (+ΔP), the valve 936 opens from its normally closed position with fluid flowing in the direction indicated by the arrow 939. However, when the differential pressure across the valve 936 is initially positive and reverses to become a negative differential pressure (−ΔP), the valve 936 opens from its normally closed position with fluid flowing in the opposite direction as indicated by the arrow 937. Consequently, the combination of the valves 936 and 938 function as a bidirectional valve permitting fluid flow in both directions in response to cycling of the differential pressure (ΔP).

Figure 13:
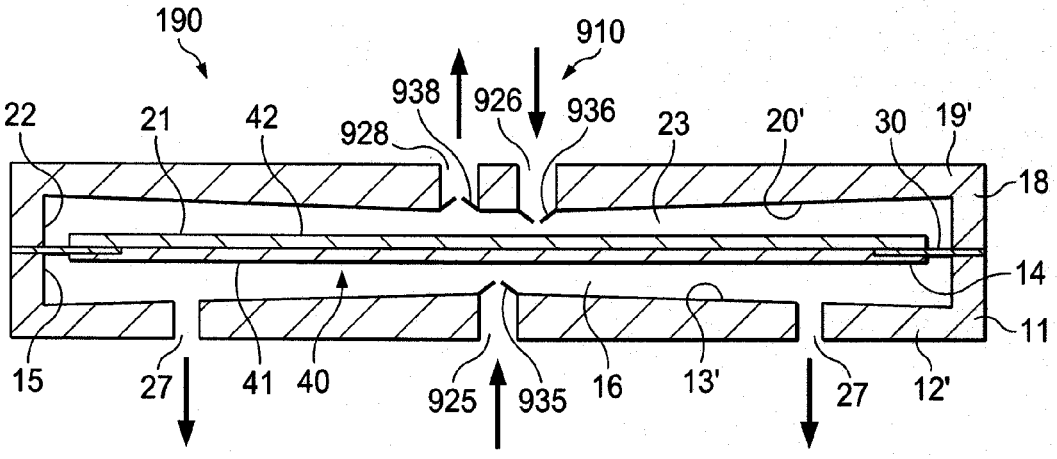
FIG. 13 shows a schematic cross section of a two-cavity pump similar to the pump of FIG. 11 in which end walls of the cavities are frusto-conical in shape.

Referring now to FIG. 13, a pump 190 according to another illustrative embodiment of the invention is shown. The pump 190 is substantially similar to the pump 90 of FIG. 11 except that the pump body has a base 12' having an upper surface forming the end wall 13' which is frusto-conical in shape. Consequently, the height of the cavity 16' varies from the height at the side wall 15 to a smaller height between the end walls 13', 14 at the center of the end walls 13', 14. The frusto-conical shape of the end wall 13' intensifies the pressure at the center of the cavity 16' where the height of the cavity 16' is smaller relative to the pressure at the side wall 15 of the cavity 16' where the height of the cavity 16' is larger. Therefore, comparing cylindrical and frusto-conical cavities 16 and 16' having equal central pressure amplitudes, it is apparent that the frusto-conical cavity 16' will generally have a smaller pressure amplitude at positions away from the center of the cavity 16'; the increasing height of the cavity 16' acts to reduce the amplitude of the pressure wave. As the viscous and thermal energy losses experienced during the oscillations of the fluid in the cavity 16' increase with the amplitude of such oscillations, it is advantageous to the efficiency of the pump 190 to reduce the amplitude of the pressure oscillations away from the center of the cavity 16' by employing a frusto-conical design. In one illustrative embodiment of the pump 190 where the diameter of the cavity 16' is approximately 20 mm, the height of the cavity 16' at the side wall 15 is approximately 1.0 mm tapering to a height at the center of the end wall 13' of approximately 0.3 mm. Either one of the end walls 13' or 20' may have a frusto-conical shape.

As shown above in FIG. 9A, the positive differential pressure 55 is applied across the valve 50 over the positive pressure time period ($t_{p+}$) and the negative differential pressure 65 is applied across the valve 50 over the negative pressure time period ($t_{p-}$) of the square wave. When the actuator 40 generates the positive differential pressure 55 in the cavity 16, a contemporaneous negative differential pressure 57 is necessarily generated in the other cavity 23 as shown in FIG. 9C. Correspondingly, when the actuator 40 generates the negative differential pressure 65 in the cavity 16, a contemporaneous positive differential pressure 67 is necessarily generated in the other cavity 23 as also shown in FIG. 9C. FIG. 9C shows a graph of the operating cycle of the valves 936 and 938 between an open and closed position that are modulated by the square-wave cycling of the contemporaneous differential pressures 57 and 67. The graph shows a half cycle for each of the valves 936 and 938 as each one opens from the closed position. When the differential pressure across the valve 936 is initially negative and reverses to become a positive differential pressure (−ΔP), the valve 936 opens as described above and shown by graph 946 with fluid flowing in the direction indicated by the arrow 937 of FIG. 12. However, when the differential pressure across the valve 938 is initially positive and reverses to become a negative differential pressure (−ΔP), the valve 938 opens as described above and shown by graph 948 with fluid flowing in the opposite direction as indicated by the arrow 939 of FIG. 12. Consequently, the combination of the valves 936 and 938 function as a bidirectional valve permitting fluid flow in both directions in response to the cycling of the differential pressure (ΔP).

Figure 14:
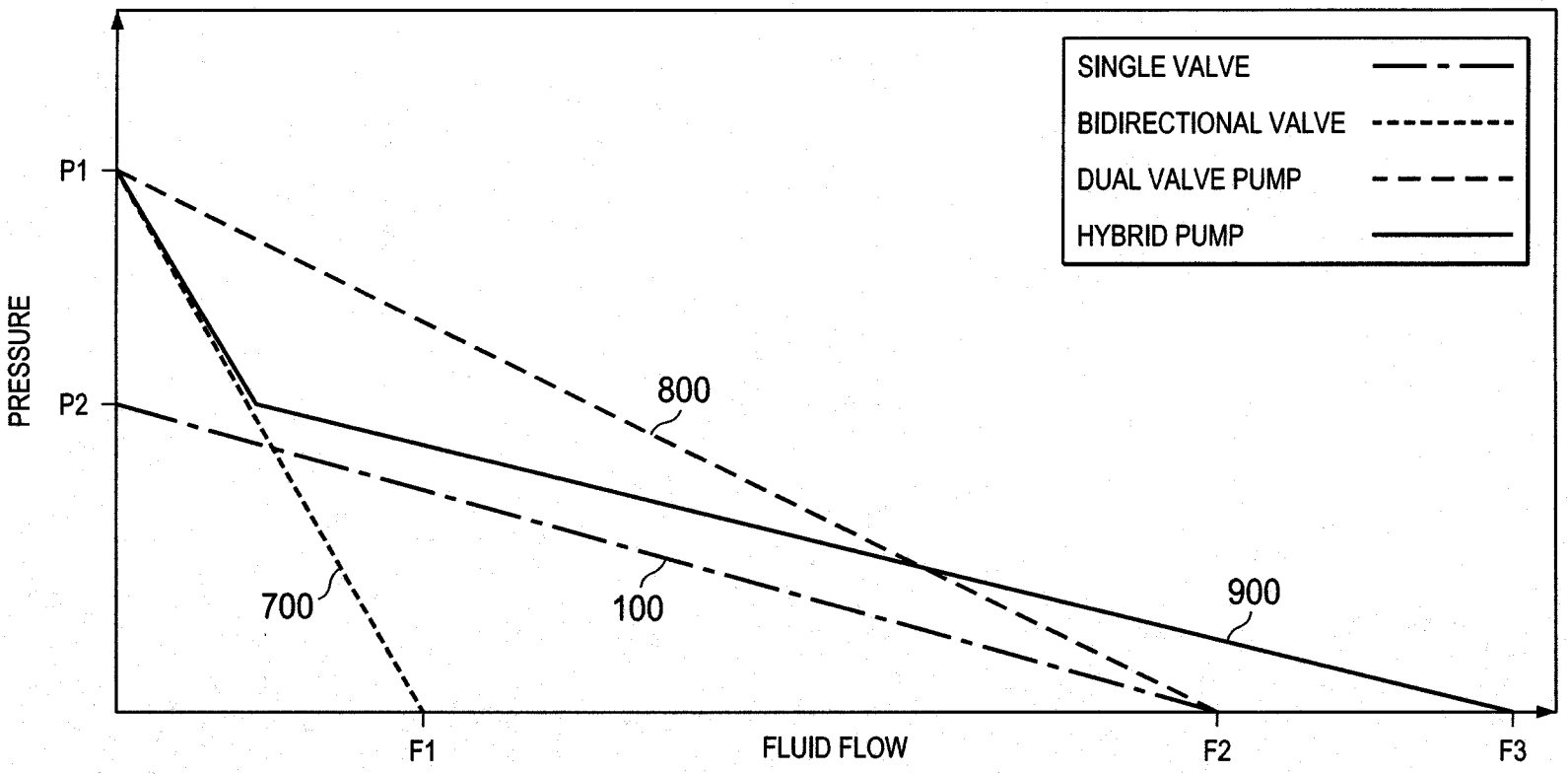
FIG. 14 shows a graph of the relative pressure and flow characteristics of the pump of FIGS. 10A-10D.

Referring to FIG. 14, pressure-flow graphs are shown for pumps having different valve configurations including, for example, (i) a graph 100 showing the pressure-flow characteristics for a single valve configuration such as pump 10, (ii) a graph 700 showing the pressure-flow characteristics for a bidirectional or split valve configuration such as the pump 70, (iii) a graph 800 showing the pressure-flow characteristics for a dual valve configuration such as the pump 80 shown in U.S. Patent Application No. 61/537,431, and (iv) a graph 900 showing the pressure-flow characteristics for a hybrid pump configuration such as the hybrid pump 90. As indicated above, the bidirectional pump 70 is able to deliver a higher differential pressure than the single-valve pumps 10 and 60 under the same drive conditions, which is illustrated by the graph 700 showing that a higher pressure P1 can be achieved but at the expense of being limited to a lower flow rate F1. Conversely, the single-valve pumps 10 and 60 are able to deliver higher flow rates then the bidirectional pump 70 under the same drive conditions, which is illustrated by the graph 100 showing that a higher flow rate F2 can be achieved but at the expense of being limited to a lower pressure P2. The dual valve pump 80 disclosed in U.S. Patent Application No. 61/537,431 is capable of achieving both the higher pressure P1 and flow rate F2, but the flow rate is limited to that value as the cavities are pneumatically coupled by an aperture extending through the actuator assembly as shown by the graph 800. The cavities 16 and 23 of the hybrid pump 90 are not pneumatically coupled through the actuator 40, allowing the cavities 16, 23 to be independently coupled in parallel by a manifold. Independent coupling generates a higher flow rate F3 than the dual valve pump 80 as shown by the graph 900. The higher flow rate F3 is useful for a variety of different applications such as, for example, the wound therapy application that requires a high flow rate for the two wound therapy conditions described above.

It should be apparent from the foregoing that the hybrid pump 90 is also useful for other negative pressure applications and positive pressure applications that require different fluid dynamic capabilities such as, for example, higher flow rates to quickly achieve and maintain a target pressure.

It should also be apparent from the foregoing that an invention having significant advantages has been provided. While the invention is shown in only a few of its forms, it is not just limited to those shown but is susceptible to various changes and modifications without parting from the spirit of the invention.

We claim:

1. A pump comprising:

a pump body having pump walls substantially cylindrical in shape and having a side wall closed by two end walls for containing a fluid;

an actuator disposed between the two end walls and being a first portion of a common end wall forming a first cavity and a second cavity, each cavity having a height (h) and a radius (r), wherein a ratio of the radius (r) to the height (h) is greater than about 1.2, the actuator operatively associated with a central portion of the common end walls and adapted to cause an oscillatory motion of the common end walls at a frequency (f), thereby generating radial pressure oscillations of the fluid within both the first cavity and the second cavity;

an isolator extending from the periphery of the actuator to the side wall as a second portion of the common wall and flexibly supporting the actuator;

a first aperture disposed at a location in the end wall associated with the first cavity and extending through the pump wall;

a second aperture disposed at another location in the end wall associated with the first cavity and extending through the pump wall;

a first valve disposed in one of the first and second apertures to enable the fluid to flow through the first cavity in one direction when in use;

a third aperture disposed at a location in the end wall associated with the second cavity and extending through the pump wall; and a second valve disposed in the third aperture to enable the fluid to flow through the second cavity in both directions when in use.

2. The pump of claim 1, wherein the radial pressure oscillations include at least one annular pressure node in response to a drive signal being applied to the actuator.

3. The pump of claim 1, wherein the first valve is a flap valve.

4. The pump of claim 1, wherein the second valve comprises two flap valves.

5. The pump according to claim 1, wherein the at least one of the first valve and the second valve is a flap valve comprising:

a first plate having first apertures extending generally perpendicular through the first plate;

a second plate having first apertures extending generally perpendicular through the second plate, the first apertures being substantially offset from the first apertures of the first plate;

a sidewall disposed between the first and second plate, the sidewall being closed around the perimeter of the first and second plates to form a cavity between the first and second plates in fluid communication with the first apertures of the first and the second plates; and, a flap disposed and moveable between the first and second plates, the flap having apertures substantially offset from the first apertures of the first plate and substantially aligned with the first apertures of the second plate;

whereby the flap is motivated between the first and second plates in response to a change in direction of the differential pressure of the fluid outside the flap valve.

6. The pump of claim 1, wherein the first cavity and second cavity are configured for a parallel pumping operation.

7. The pump of claim 1, wherein the first cavity and a second cavity are configured for a series pumping operation.

8. The pump of claim 1, wherein the actuator comprises a first piezoelectric disc and either a steel disc or a second piezoelectric disc.

9. The pump of claim 8, wherein the isolator is bonded between the first piezoelectric disc and either the steel disc or the second piezoelectric disc.

10. The pump of claim 1, wherein isolator is ring-shaped.

11. The pump of claim 1, wherein the actuator is disc-shaped.

12. The pump of claim 1, wherein the actuator has a diameter less than the diameter of the first cavity and a second cavity.

13. The pump of claim 1, wherein the sidewall extends continuously between the end walls that form the first cavity and the second cavity.

14. The pump of claim 1, further comprising a recess in the side wall for slidably receiving the isolator whereby the isolator is free to move within the recess when the actuator vibrates.

15. The pump of claim 1, wherein the isolator includes a plastic layer and one or more metal layers.

16. The pump of claim 1, wherein the isolator has a thickness between about 10 microns and about 200 microns.

17. The pump of claim 1, wherein the ratio r/h is greater than about 20.

18. The pump of claim 1, wherein the combined volume of the first cavity and the second cavity is less than about 10 ml.

19. The pump of claim 1, wherein the frequency of the oscillatory motion is equal to the lowest resonant frequency of radial pressure oscillations in the first cavity and the second cavity when in use.

20. The pump of claim 1, wherein the lowest resonant frequency of, radial fluid pressure oscillations in the first cavity and the second cavity is greater than about 500 Hz when in use.

21. The pump of claim 1, wherein the motion of the end walls is mode-shape matched to the pressure oscillation in the first cavity and the second cavity.

22. The pump of claim 1, wherein a one of the first aperture and the second aperture that does not contain the first valve is located at a distance of 0.63r plus or minus 0.2r from the center of the end wall associated with the first cavity.

23. The pump of claim 1, wherein the ratio $h^2/r$ is greater than $10^{-7}$ meters.

* * * * *